US008882611B2

(12) United States Patent
Schaaf

(10) Patent No.: US 8,882,611 B2
(45) Date of Patent: Nov. 11, 2014

(54) DIVOT REPAIR TOOL

(71) Applicant: Philip J. Schaaf, San Francisco, CA (US)

(72) Inventor: Philip J. Schaaf, San Francisco, CA (US)

( * ) Notice: Subject to any disclaimer, the term of this patent is extended or adjusted under 35 U.S.C. 154(b) by 0 days.

(21) Appl. No.: 13/669,315

(22) Filed: Nov. 5, 2012

(65) Prior Publication Data

US 2013/0065710 A1 Mar. 14, 2013

Related U.S. Application Data

(63) Continuation of application No. 13/027,008, filed on Feb. 14, 2011, now abandoned, which is a continuation of application No. 12/404,195, filed on Mar. 13, 2009, now abandoned.

(60) Provisional application No. 61/036,890, filed on Mar. 14, 2008.

(51) Int. Cl.
*A63B 57/00* (2006.01)

(52) U.S. Cl.
CPC ..... *A63B 57/0068* (2013.01); *A63B 2210/50* (2013.01); *A63B 2210/58* (2013.01)
USPC ..... 473/408

(58) Field of Classification Search
CPC . A63B 57/00; A63B 57/0068; A63B 2210/58
USPC ..... 473/408, 286; D21/793
See application file for complete search history.

(56) References Cited

U.S. PATENT DOCUMENTS

| | | | | |
|---|---|---|---|---|
| 3,185,483 | A * | 5/1965 | Klynman | 473/286 |
| 3,456,737 | A * | 7/1969 | Rhyme | 172/381 |
| 3,539,017 | A * | 11/1970 | Johnson | 172/378 |
| D238,436 | S | 1/1976 | McKelvey | |
| 5,121,519 | A * | 6/1992 | Haugom | 15/105 |
| 5,449,169 | A * | 9/1995 | Hardin et al. | 473/408 |
| 5,529,299 | A * | 6/1996 | Bellagamba | 473/285 |
| 5,562,553 | A * | 10/1996 | Digerness et al. | 473/408 |
| 5,759,120 | A * | 6/1998 | Mathis et al. | 473/408 |
| 6,176,792 | B1 | 1/2001 | Tate | |
| 6,217,465 | B1 * | 4/2001 | Kenia, Jr. | 473/408 |
| 6,413,174 | B1 | 7/2002 | Roberts | |
| D463,522 | S | 9/2002 | Goessling, Jr. | |
| 6,565,458 | B1 * | 5/2003 | Cameron | 473/408 |
| 6,572,495 | B1 * | 6/2003 | Ferrari | 473/408 |
| 6,620,062 | B2 | 9/2003 | Taylor et al. | |
| 6,699,144 | B1 * | 3/2004 | Kvitek | 473/408 |
| 6,837,807 | B1 * | 1/2005 | Kerr | 473/408 |
| 6,994,639 | B2 | 2/2006 | Parks et al. | |
| D538,374 | S * | 3/2007 | Dow | D21/793 |
| 7,238,125 | B2 * | 7/2007 | Dymling | 473/408 |
| 7,238,126 | B1 * | 7/2007 | Wiens et al. | 473/408 |
| D580,002 | S | 11/2008 | Littmann | |
| 7,611,426 | B1 | 11/2009 | Bradshaw | |
| 7,731,609 | B2 | 6/2010 | Wiens et al. | |

(Continued)

*Primary Examiner* — Steven Wong
(74) *Attorney, Agent, or Firm* — Foley & Lardner LLP

(57) ABSTRACT

A divot repair tool includes a blade member coupled to a handle disposed relative to the blade at an angle advantageous to ball mark repair. The blade member may be movable with respect to the handle between an open position and a closed position. The tool can include one or more indentations or other indicia to indicate how to properly grip the handle, as well as indicia indicating proper use of the divot repair tool.

13 Claims, 23 Drawing Sheets

(56) References Cited

U.S. PATENT DOCUMENTS

| | | | | |
|---|---|---|---|---|
| D645,531 | S * | 9/2011 | Nebbia | D21/793 |
| 2006/0009313 | A1 * | 1/2006 | Parks et al. | 473/408 |
| 2006/0063614 | A1 | 3/2006 | Bellagamba | |
| 2007/0149325 | A1 * | 6/2007 | Vargas | 473/408 |
| 2008/0051227 | A1 | 2/2008 | Otsubo | |
| 2008/0125251 | A1 | 5/2008 | Sheehan | |
| 2009/0163300 | A1 | 6/2009 | Lueders | |

* cited by examiner

DIVOT REPAIR TOOL

CROSS REFERENCE TO RELATED APPLICATIONS

This application is a continuation of and claims priority to U.S. application Ser. No. 13/027,008, filed on Feb. 14, 2011 entitled DIVOT REPAIR TOOL, now abandoned which is a continuation of and claims priority to U.S. application Ser. No. 12/404,195, filed on Mar. 13, 2009, entitled DIVOT REPAIR TOOL, now abandoned which application claims priority to U.S. Provisional Application No. 61/036,890 filed on Mar. 14, 2008, entitled DIVOT REPAIR TOOL. The disclosures of each of the above-listed applications are herein incorporated by reference in their entirety.

BACKGROUND

High-maintenance by design, golf course putting greens require special watering, mowing and growing techniques. Oftentimes, their playability dictates the competitive quality of the test for the golfer. Thus, the integrity of their condition is of paramount concern to golf course owners and operators.

The putting surface, however, is susceptible to flying golf balls. At least eighteen times in a golfer's round, the ball will enter the green, many times leaving a damaging mark, known as a "divot," that looks like a small crater. More precisely, at the point of contact with the putting surface, the spinning golf ball splits the green's surface and separates the grass by leaving a depression up to a half-inch in depth and a full inch (or more) in length. Unrepaired divots present a problem for both golfers and groundskeepers.

Many golfers are equipped with traditional divot repair tools. However, the tools tend to be underutilized and/or ineffectively used. A number of patents related to divot repair tools have issued. There are several retractable divot repair tools that store a blade member in the cavity of a housing when not in use and allow a golfer to deploy them for application in divot repair. One example, U.S. Pat. No. 6,837,807 (Kerr) features a housed device that has a power assisted blade member and a locking mechanism that can be activated when held in the hand. Another example, U.S. Pat. No. 6,620,062 (Taylor, Pearman) discloses a retractable device that allows the tines to leverage a spring to be deployed and contracted into a housing. Another tool, U.S. Pat. No. 7,238,125 (Dymling) discloses that tines can be stored in a housing and deployed with a sliding mechanism for use.

Described herein are improved divot repair tools.

SUMMARY

Generally, embodiments relate to tools for golfers. In particular, embodiments relate to tools, including some that are retractable, for repairing ball marks on greens, also known as divots.

Some embodiments relate to divot repair tools. The tools can include, for example, a blade member; and a handle operatively coupled to the blade member and disposed at an angle of between 110° and 160° from the blade member. The handle can be disposed at an angle of between 120° and 150° from the blade member. In some preferred aspects, the handle can be disposed at an angle of about 135° from the blade member. The blade member can include, for example, at least one tine or a plurality of tines. In some aspects the at least one tine can be substantially straight, for example not being angled by more than about 1-5 degrees. In some aspects the at least one tine can be angled or curved, for example, upwardly or downwardly curved or angled. The at least one tine can be movable with respect to the handle. The at least one tine can be slidably retractable into a stored position. Also, the at least one tine can be slidably retractable into a stored position within a cavity located in the tool's housing. The at least one tine can be embedded in a depression or cavity located on the external casing of the handle. The at least one tine can be moved or pivoted for storage to a position parallel to the undercarriage of the handle, sometimes where parts of the at least one tine can be flush against the undercarriage. The at least one tine can be, for example, pivotally movable into a stored position. The handle can have, for example, a length selected to accommodate at least three fingers of a user. The handle can be sized, for example, to accommodate substantially all of a width of a hand of a user. In some aspects the handle can be of a size that does not substantially exceed the size of the user's hand. For example, the device may be of a length less than the size of the user's hand or of a length that does not exceed the length of the user's hand by more than about 1-3 inches. In some aspects handle can have, for example, a length of at least about 1.5 inches, a width of at least about 0.75 inches and height of at least about 0.5 inches. The handle can include, for example, at least one index configured to indicate to a user how to grip the handle. For example, the at least one index can include an indentation in an upper or outer surface of the handle, the indentation being configured to receive a thumb of the user. The at least one index can include, for example, at least one indentation on a lower surface of the handle, the indentation being configured to receive a finger of the user. The at least one index can include, for example, user instructions disposed on the handle. The instructions can be integrally formed with the handle. The instructions can include instructions for gripping the handle. The user instructions can include, for example, instructions for repairing a divot. In some aspects the handle can be provided with a cavity configured to releasably retain at least one golfing tee. The at least a portion of the blade member can be, for example, pivotally movable with respect to the handle. In some aspects the handle can include a detachable ball marker. The handle can include a display portion for displaying promotional information. In some aspects the external parts of the tool can include a display portion for displaying promotional content, artwork, designs and other information.

In another embodiment, the handle may include at least one index configured to indicate to a user how to grip the handle. The at least one index can include, for example, an indentation in an upper surface of the handle, the indentation being configured to receive a thumb of the user. The at least one index can include, for example, at least one indentation on a lower surface of the handle, the indentation being configured to receive a finger of the user. The at least one index can include user instructions disposed on the handle. The instructions can be integrally formed with the handle. The instructions can include instructions for gripping the handle. The instructions can further include instructions for repairing a divot. For example, the instructions can include at least a portion of the following: a. Place thumb in depression and wrap hand around tool b. Insert forks at edges of ball mark c. Move tool towards center of ball mark by lifting rear of handle; and d. Repeat as necessary. In another embodiment, the handle can be provided with a cavity configured to releasably retain at least one golfing tee. In another embodiment, at least a portion of the blade member is pivotally movable with respect to the handle. In another embodiment, the handle can include a detachable ball marker. In another embodiment, the handle can include a display portion for displaying promotional information. In many embodiments, the rear end of the handle, that is the end opposite the blade member, can be of a blunt construction that makes it suitable to tamp down, or further smooth to a firm state, the turf after the tines have agitated the affected ground back to a reasonably level state.

Some embodiments relate to integrated systems where the tines are deployable. For example, the tines can be deployable from an open end on the tool's housing and dispose the blade member relative to the housing at a suitable angle for ball mark repair. Integrated systems can include embedded tines in a housing where the tines are activated via a button, trigger, squeeze system where the act of squeezing a place or places on the handle activates the blade member. Another activation means is a spring loaded mechanism where the deployed or contracted positions of the blade member are released and locked into place via a pin and rod system. Another integrated system can include a blade member sliding on a rail or a grooved track in the cavity of a tool's housing where said blade member can be attached directly to a visibly exposed activation mechanism located on an external side of the tool's housing. The blade member in the cavity of a tool's housing can also be attached to an intermediate component that might not be visibly exposed, but where the said intermediate component is attached to the externally located activation mechanism. In other words, there can be engineered conduits and components to processes involved in the activation process between a blade member and an activation mechanism. A further mechanism to deploy the tines from a concealed, retracted position in the housing of the tool can be similar to operating the common ball point pen, where a small spring is attached to the outside of the connective upper portion of the tines where a button can be pushed to either deploy for use or contracted back into the housing for storage. A further embodiment can connect the tines to a movable hinge that deploys to a fixed, locked position when the blade member exits the housing via a pin and rod system, clasp or insert to a plate and then retracts the blade member by reversing the process. Another integrated system can fold the tines under the handle carriage, or into the handle carriage via a hinge, or similar, mechanism.

In some embodiments where the blade member retracts, the blade member can be concealed and stored in the housing with either a vertical or horizontal bias, for example, depending upon the design and dimensions of the housing. The housing for the blade member serves as the handle in divot repair and it can be designed in many shapes to provide leverage, comfort and intuitive use in gripping the tool for ball mark repair. The housing, for example, can have a thumb depression on the top side of the tool and contours on the undercarriage of the tool for some, or all, of the fingers of the hand. In some embodiments, the tool's housing can have, for example, a length of at least 1.5 inches, a width of at least 0.75 of an inch and/or a height of at least 0.5 of an inch from the point where the tines exit the housing to the top of the tool. Depending upon the embodiment, the tines can be disposed at a variety of angles from the housing in order to repair a divot and the housing can be made of a variety of materials, including types of metal, hard plastic and related polymers and any combination thereof.

Some other embodiments relate to divot repair tools that include, for example, a blade member and a grip or handle operatively coupled to the blade member through a joint, wherein the joint is configured to fix the blade member at an angle relative to the grip of between 110° and 160°. Some embodiments relate to divot repair tools that include, for example, a blade member, a handle operatively coupled to the blade member through a joint, wherein the handle has a cavity for storing said blade member, a retraction mechanism that releases said blade member wherein the joint is configured to fix the blade member at an angle relative to the grip of between 110° and 160°; and a retraction mechanism that retracts said blade member for storage in said cavity of said handle. In some aspects, the joint can be configured to fix the blade member at an angle relative to the grip of between 120° and 150°. In another embodiment, the joint can be configured, for example, to fix the blade member at an angle relative to the grip of between 130° and 140°. In another embodiment, the joint can be configured to allow the blade member to pivot toward the handle to a closed position. In another embodiment, the joint can include a hinge. In another embodiment, in the closed position, the blade member lies substantially within a cavity of the handle. In another embodiment, the grip can have a length of 1, 2, 3, 4, 5, 6, 7 or 8 inches, for example, or any of the distances in between, and preferably in some aspects can have a length of at least 1.5 inches, a width of at least 0.75 inch and/or a height of at least 0.5 on an inch. In another embodiment, the grip can be sized to accommodate substantially all of a width of a hand of a user. In another embodiment, the grip can include indicia and/or contour(s) indicating how to hold the grip. The indicia can comprise a depression configured to accommodate a thumb of the user, the depression being disposed on an upper surface of the grip. There can also be contours disposed on the sides and undercarriage in embodiments of the tool. In another embodiment, the blade member can include a plurality of tines. In some aspects, the tines can be, for example, curved or substantially straight. The blade member can be stored in the cavity of a tool's handle with a horizontal or vertical bias, for example. In some aspects, the housing that stores the at least one tine can be a handle that conforms to a user's hand. The tine(s) can be deployed from the handle. In some aspects the housing can open and close for cleaning and maintenance.

Some embodiments relate to divot repair tools for use on a golfing green that include a grip and a joint. The grip can have, for example, a length of at least 1.5 inches, the grip comprising a first end, a second end, and at least one index for signaling to a user how to take hold of the grip. The joint can be for connecting the first end of the grip with a blade member, the blade member comprising at least one tine sized for removable insertion into the golfing green, wherein the joint is capable of fixing the fork at an angle relative to the grip of greater than 110°. In some aspects, the at least one index can include a depression sized and shaped to accommodate a thumb of the user. In another embodiment, the at least one index can include a plurality of contours indicating the position on the grip where the fingers should be placed. In another embodiment, the at least one index can include, for example, instructions formed integrally with the grip for instructing the user how to take hold of the grip. The instructions can further instruct the user how to use the tool to repair a divot. For example, the instructions can include at least a portion of the following: a. Place thumb in depression and wrap hand around tool b. Insert forks at edges of ball mark c. Move tool towards center of ball mark by lifting rear of handle; and d. Repeat as necessary. In another embodiment, the at least one tine can have, for example, a length generally between 0.5 inch and 1.75 inches and a width generally between 0.0625 inch and 0.4375 inch, including tapered tine tools, where the at least one tine's size is relative to the design and length, width and height of the embodiment. In another embodiment, the grip can include a cavity in the second end for receiving at least a portion of at least one golfing tee.

Still further embodiments relate to methods of repairing a divot, which can include, for example, forcing turf in a generally horizontal direction, from an edge of the divot toward a center of the divot, using a generally vertical motion applied to a handle of a divot repair tool, wherein the tool when inserted into the ground is configured to permit the user to leverage the handle of the tool away from the ground. Some embodiments relate to methods of repairing a divot, comprising providing a divot repair tool, the tool comprising a blade member and a handle operatively coupled to the blade member, the handle being disposed at an angle of between 110° and 160° from the blade member; inserting the blade member into the ground at a first location near an edge of the divot; moving the handle in a generally vertical direction so as to push the ground near the edge of the divot toward the center of the divot; repeating said inserting and said moving at one or more additional locations around the edge of the divot until the turf that has been damaged by the flying golf ball is adequately repaired. For example, the pushing the ground near the edge of the divot can be in a horizontal motion, for example. The "blade" member can include tines (e.g., forks). The blade member can be a unitary piece or it can be more than one piece (e.g., two separate tines individually connected to the handle or to a storage and deployment system located in a cavity inside the handle or a cavity on the outside of the handle). Furthermore, the "blade" member in some aspects can be relatively flat, but can also comprise non planar tines, etc.

The foregoing is a summary and thus contains, by necessity, simplifications, generalization, and omissions of detail; consequently, those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and, therefore, are not to be considered limiting of its scope; the disclosure will be described with additional specificity and detail through use of the accompanying drawings. An apparatus according to some of the described embodiments can have several aspects, no single one of which necessarily is solely responsible for the desirable attributes of the apparatus. After considering this discussion, and particularly after reading the section entitled "Detailed Description" one will understand how the features described herein provide a number of advantages.

DETAILED DESCRIPTION

Figure 1A:
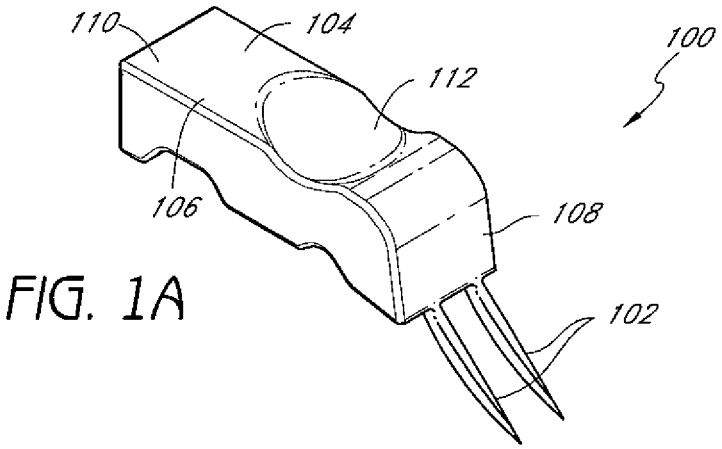
FIG. 1A is a perspective view of a divot repair tool according to an embodiment.

The features, aspects and advantages of the technology will now be described with reference to the drawings of several embodiments, which are intended to be within the scope of the invention herein disclosed. These and other embodiments will become readily apparent to those skilled in the art from the following detailed description of the embodiments having reference to the attached figures, the invention not being limited to any particular embodiment(s) disclosed.

As mentioned above, unrepaired divots present a problem for both golfers and groundskeepers. Unrepaired divots can alter the intended travel of a golf ball on a putting green, beyond anything that could be anticipated through normal visual inspection of the turf, thereby frustrating golfers beyond the normal degree. Left unrepaired, or improperly repaired, a divot will in many cases lead to death of the turf in the immediate vicinity of the divot, because of the disruption or traumatic compaction of the root system. Neither player, nor golf course operator wants the putting surface to be damaged, compromised or altered in terms of the test it offers.

Traditional divot repair tools are of a generally flat, planar construction and involve a pair of tines extending from a base. The tines are generally tapered and, to varying degrees, are pointed at their distal ends. Tools of a planar nature generally provide poor leverage and do not intuitively guide the user to properly repair ball marks when inserted in the ground. For example, once a planar divot tool is inserted into the affected turf, the user has a choice of two directions to move the device: either to push the divot repair tool forward towards the center of the ball mark or to pull the tool back and lift the divot from its nadir. Pushing the turf forward is the correct choice as it allows the grass to stay connected to its root system, draw water and quickly re-grow. Pulling the turf up from the lowest point or nadir of the ball mark, on the other hand, often separates the grass from the root system, which kills the grass and leaves a dead spot on the green. This means that there is a 50% chance that a well-intentioned golfer can make the wrong decision in divot repair with a planar divot repair tool once the tines enter the ground, the moment when it matters most to the health of the putting green.

Some embodiments described herein overcome many of the drawbacks of prior tools. Generally, embodiments relate to improved repair tools, methods of repairing divot marks and other methods related to the same. Some embodiments of the tools and methods described herein reduce the chances of golfers making the wrong choice in ball mark repair while providing increased leverage and other improvements to the art of the task.

The purpose of using a divot tool is to penetrate the turf beneath a divot and de-compact the dirt by mechanically agitating it to push the surface back to its original contour and allow the ground to naturally recover from the trauma of receiving a flying, spinning dimpled golf ball. Proper use of a divot tool requires multiple manipulations in order to sufficiently de-compact the soil as to adequately repair the divot without tearing the grass roots from the root system that exists below the green's surface. To properly repair a ball mark, preferably the tool can be inserted into the green at the edge of the ball mark. Then, using the tool, the turf can be pushed in from the edge of the ball mark toward the center of the indentation. This manipulation then can be repeated around the edges of the indentation, so as to close the gap in the impacted turf. The conventional two-dimensional tool, however, is not intuitive to apply, can be hard to handle and manipulate, and many golfers simply do not know how to repair a ball mark correctly. A common mistake that many golfers make is to insert the tool under the indentation area and pull up the tines from multiple points near the lowest point or nadir of the ball mark in order to restore a smooth quality to the putting surface. This practice might give the immediate appearance of a repaired ball mark, but it often tears the grass away from its roots, resulting in an inevitable dead spot on the green. Thus, a well intended golfer can appear to fix his or her mark, only to have that particular spot die a couple of days later because he or she tore away the roots. Even where a golfer does know the proper repair manipulations, the discomfort and unwieldiness of using conventional divot tools causes some golfers forego the process altogether. This is a definite breach of etiquette in the golf world and one that can ultimately cost golf courses hundreds thousands of dollars to repair their greens. In fact, many golf courses have seven figure budgets to maintain their putting greens, sometimes shutting them down for several weeks to let the grass recover/regrow from damage sustained. Golf courses, furthermore, often put verbiage on scoreboards, in signs on golf carts and even in signs posted around golf greens reminding golfers to fix ball marks. Some signs even feature instructional diagrams to facilitate the process. Improvement to this facet of the golf experience, therefore, is desirable to both the supply and demand side of the golf industry.

Figure 7A:
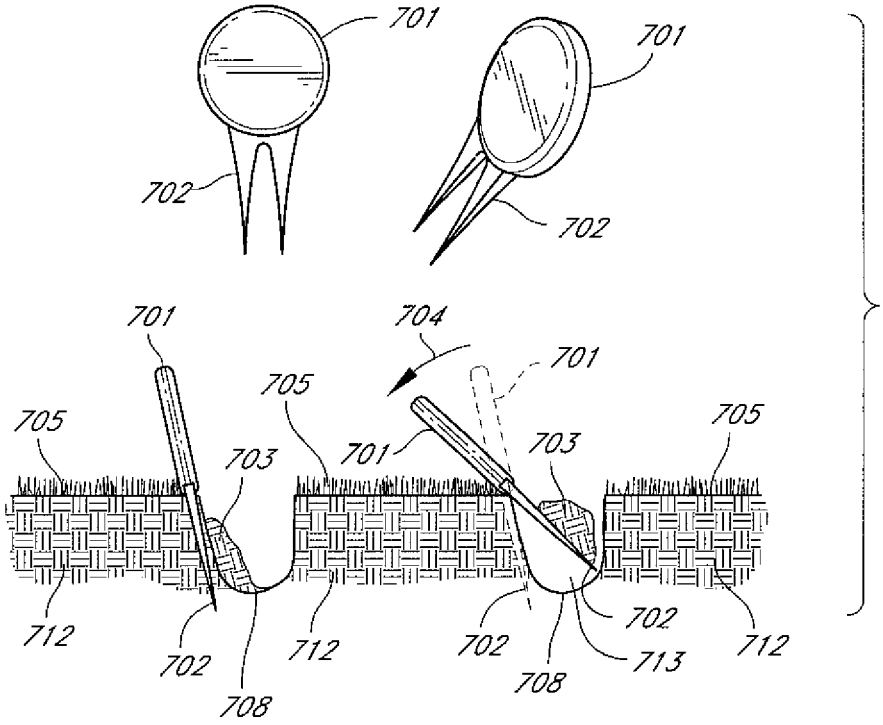
FIG. 7A is an illustration of repairing a ball mark according to a traditional divot repair tool.
Figure 7B:
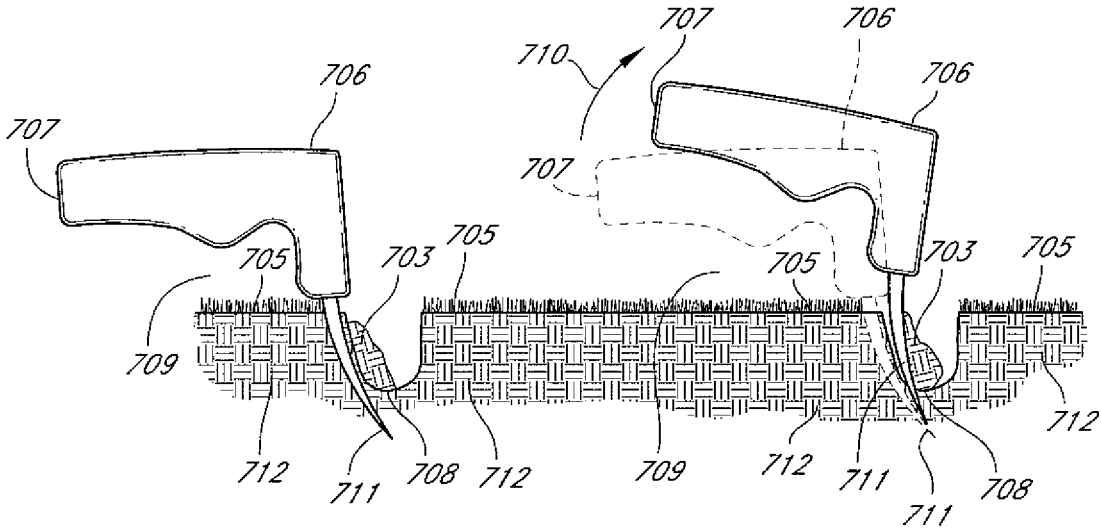
FIG. 7B is an illustration of repairing a ball mark according to an embodiment of the instant subject matter.

FIGS. 7A-7B are illustrations that compare working examples of a traditional divot repair tool versus an embodiment of the instant subject matter. FIG. 7A shows a traditional divot repair tool that goes from being perpendicular to a surface to plunging into turf to repair a ball mark. Once the tines 702 are sunk into the grass 705 and ground 712, the user can either push forward on the top of the tool 701, or pull back on the top of the tool 701 in an attempt to repair the ball mark 703. If the user pulls back 704 on the top of the tool 701 to lift the ball mark from its nadir 708, the tines 702 might temporarily restore the surface to a smooth appearance immediately suitable for putting, but there is a high likelihood that the action has torn 713 the root system between the exposed grass 705 and the ground 712 that nourishes it. Tearing 713 of the root system in the ground 712 will ultimately result in a dead spot on the putting green, which creates a small crater. Small craters on the putting green's surface, in turn, impede and alter a putted ball's trajectory as it rolls towards the actual hole. Improper ball mark repair, therefore, has negative consequences for both the golfer and golf course. FIG. 7B, comparatively, demonstrates what occurs when one repairs a ball mark with an embodiment of the instant subject matter. Using tool 706, the tines 711 enter the grass 705 and ground 712 to repair the divot 703. At this juncture, the user can only pull the handle in an upward movement 710 from its rear 707 and push the newly damaged turf back towards the center of the divot to fill in the affected area. This vertical repair movement 710, facilitated by the design of tool 706 and its related embodiments, pushes the turf horizontally and leaves the relationship of the grass 705 to its root system in the ground 712 intact, thereby allowing the grass 705 to re-grow and help the putting green return to its state prior to the flying golf ball creating the divot. Furthermore, if the user tried to use tool 706 to pull the damaged turf up from the nadir 708 of the ball mark, he/she could not do it because his/her hand would hit the ground first and effectively block the action. This blocking would occur because the user grips the tool 706 by wrapping his/her hand around the handle and the space 709 would be occupied with the fingers of the user's hand. Thus, the tool of the instant subject matter helps eliminate the chance of moving the turf in the wrong direction during the act of ball mark repair. Lastly, the traditional tool is unwieldy, uncomfortable and does not conform easily to the hand, nor does it provide quality leverage in the art of executing ball mark repair.

When in use, the traditional tool permits too many choices that result in poor application of effort despite honor of intent. The traditional tool, in all its various forms, also robs the user of valuable leverage in the art of ball mark repair. In short, approaching a ball mark can be mentally mysterious, physically difficult and ultimately damaging to the green.

In some embodiments described herein, the new devices can be designed in such a way so as to encourage only the proper insertion and levering angles—where the user easily pushes the earth towards the center of the ball mark depression, giving the surface the best chance to heal.

The addition in some aspects of an ergonomic, contoured handle to affix the forks of the divot tool at an advantageous operational angle provide a dramatic improvement in the effectiveness and ease of fixing ball marks.

When the golfer approaches a ball mark with a tool according to some of the embodiments in hand, the device can be easily levered—towards the center of the newly created ball mark. The simple action of the handle mechanism can help push the earth back to a smooth surface that can easily, naturally, return to its original shape. Because the handle dramatically improves and enhances the leverage of the device, the repair action also requires less effort, even making the task simple and enjoyable.

In short, some embodiments relate to devices that have a shape that conforms to the hand, palm and fingers and allows the user to access the benefits of leverage in a way that minimizes the chances to do the task improperly. For example, one of the benefits of many embodiments of the tool is that the user can put his/her weight on the tool to help sink the blade member into the turf, which can sometimes be very hard.

Some embodiments described herein relate to a divot repair tool or device that is designed specifically to create optimal points of leverage and intuitive repair methods in approaching the task of ball mark repair. In some aspects the device's design balances tines that may be straight or curved, in connection to a handle, that may be of varying lengths or shapes, to improve ball mark repair. Some embodiments also relate to methods of using the tools and methods of repairing divots.

Embodiments thus advantageously provide an improved divot repair tool for golfers, which, because of its increased effectiveness and efficiency of use, will afford more effective divot repair, and prompt more consistent attempts at divot repair. Furthermore, in some embodiments the devices are safer, including more ergonomically safe for users due to putting less strain on the hand of the user, for example.

With reference now to FIGS. 1A-1D, a divot repair tool 100 according to an embodiment is illustrated. The tool 100 includes a pair of tines 102 and a handle 104. The tines 102 can have a generally flat configuration, or can be curved slightly upward towards their distal ends as shown in FIGS. 1A-1D. Each of the tines 102 can be essentially straight, or can be tapered slightly toward the distal end, for example. The tines 102 can extend substantially parallel to one another, or can point slightly inward toward each other as shown in FIG. 1A, for example. The tines 102 can also have any other configuration consistent with their intended use. For example, although illustrated with a pair of tines, embodiments of the invention can include only a single blade or tine, or more than two tines.

Figure 1B:
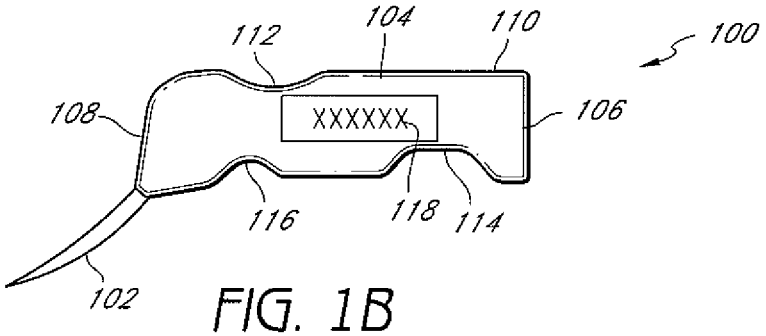
FIG. 1B is a left side view of the divot repair tool of FIG. 1A.
Figure 1C:
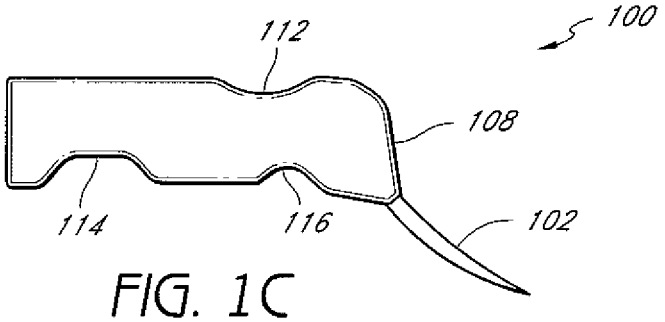
FIG. 1C is a right side view of the divot repair tool of FIG. 1A.
Figure 1D:
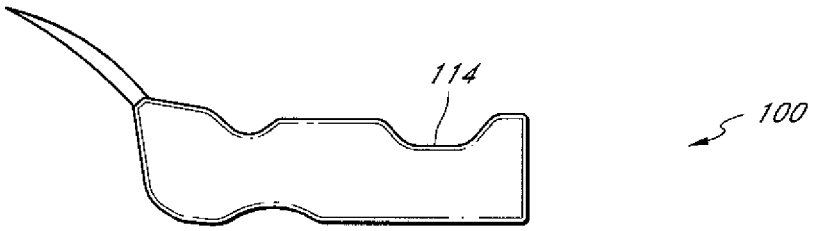
FIG. 1D is a bottom plan view of the divot repair tool of FIG. 1A.

With continued reference to FIGS. 1A-1D, the handle 104 includes a grip portion 106 and a joint portion 108 which connects the grip portion 106 to the tines 102. As illustrated in FIG. 1B, the grip portion 106 can be disposed at an angle with respect to the tines 102 such that, when the grip portion 106 is about horizontal (that is, when it is about parallel with the ground), the tines 102 are disposed at an appropriate angle to be inserted into the ground at the edge of a divot. The configuration of the grip portion 106 and its placement relative to the tines 102 advantageously provides a user with increased leverage, as well as an intuitive, comfortable grip, as the user executes the task of ball mark repair. For example, grip portion 106 may, for example, be disposed at an angle of greater than about 90° and less than about 180°. Preferably, the grip portion 106 may, for example, be disposed at an angle of greater than, less than, or about 110°, 120°, 130°, 135°, 140°, 150°, or 160° with respect to the tines 102, or within a range defined by any of these two values. The grip portion 106 can be sized and shaped to accommodate most of, or substantially all of, the width of a user's hand, for example. The grip portion 106 may have a length, for example, of greater than, less than, or about 1½, 2, 2½, 3, 3½, 4, 4½, 5, 5½, 6, 6½, 7, 7½, or 8 inches for example, or a range defined by any of these two values. The grip portion 106 can have a width, for example, of greater than, less than, or about ¾, 1, 1½, 2, 2½, or 3 inches or a range defined by any of those two values. The grip portion 106 can have a height, for example, in portions, rear front or middle of greater than, less than, or about ½ to 4 inches or a range defined by any of those two values. The grip portion 106 can have a cross-sectional shape, which is, for example, generally circular, generally oblong, or generally rectangular. Alternatively, to reduce bulk and/or weight, the grip portion 106 can have an essentially flat or shoehorn-like configuration. The cross-sectional shape of the grip portion 106 may remain substantially the same along the length of the grip portion, or may have a changing shape along the length. Of course, the grip portion 106 may alternatively have any other configuration consistent with its intended use, including being of hollow or solid construction.

The repair tool 100 can also include one or more features configured to indicate to a user the proper grip of the tool 100. For example, the grip portion 106 can be provided on its upper surface 110 with a depression 112 configured to receive a user's thumb. The depression 112 can be configured to enhance gripping of the tool 100 by a user, as well as aid the user in the correct application and usage of the tool 100. The grip portion 106 can also be provided with one or more contours 116 configured to receive and cradle one or more of a user's fingers as they wrap around the grip portion 106. The contours 116 can be provided on a lower surface 114 of the grip portion 106, as shown in the figure. Of course, other or additional contours can be provided anywhere else on the grip portion 106 to enhance gripping and usage of the tool 100. For example, one or more contours can be provided on the sides, bottom, and proximal (relative to the user) portions of the grip portion 106. Additionally or alternatively, the tool 100 can be provided with one or more protrusions, for example on an upper or lower surface of the grip portion 106 or on a surface of the joint portion 108, configured to achieve the same function. Such a protrusion can also serve as a resistance member configured to aid a user in inserting the tool 100 into the turf or balancing or supporting the tool against turf when one repairs the divot.

The repair tool 100 can further include indicia for indicating a proper grip and/or use of the tool 100. Such indicia can comprise, for example, user instructions displayed on a display portion 118 of the handle 104. Such user instructions can include, for example, images and/or text describing or indicating to a user how to properly grip the tool and/or how to properly repair a ball mark. For example, the instructions can include at least a portion of the following: a. Place thumb in depression and wrap hand around tool b. Insert forks at edges of ball mark c. Move tool towards center of ball mark by lifting rear of handle; and d. Repeat as necessary. It should also be noted that in some embodiments the device can include paper or electronic instructions, for example with the product packaging, a companion DVD or a special website with video/audio/textual/graphical instructions. The device can also be a part of an infomercial marketing campaign where the attributes of the tool are presented by a spokesperson, celebrity or otherwise, in a video or DVD format. The tool 100 can also include a display portion, for example on an upper or side surface of the handle 104, for the printing of advertising, artwork, logos, text and/or images. The repair tool 100 can optionally include various other features to provide additional functionality. For example, embodiments can include a handle which is provided with one or more cavities or recesses configured to releasably secure a ball marker (for example via snaps or magnets) or a golf tee within or upon the handle. Furthermore, the handle can take many shapes, lengths and combinations thereof to increase leverage and the intuitive application of the device to ball mark repair. The presence of a handle also can eliminate—to a very high degree of probability—the chances of the golfer inadvertently damaging the green through an improper application of the tool. As noted earlier, the presence of the handle can mean that the golfer cannot pull the mark away from the roots of the grass after the tines have been inserted because the handle will hit the surface of the green before an improper action can be executed against the root system of the putting green's grass.

The tool 100 can have, for example, a unitary construction, or can include separate parts which are fixedly or movably coupled to one another. For example, the tines 102 can comprise the same material as, and be continuous with the joint portion 108, or can comprise a separate part or parts which are fixedly or movably secured to the joint portion 108. Additionally, the joint portion 108 can be integral with the grip portion 106, or can be a separate part which is coupled to the grip portion by any suitable means. In embodiments in which the tines 102, the joint portion 106, and/or the grip portion 108 comprise separate parts, these parts can be fixedly or movable secured to one another by any suitable means, such as adhesive, pins, rivets, screws, hinges, or spring-loaded couplings. The tine or tines 102 can comprise any material suitable for their intended purpose, such as, for example, metal or a polymer such as a rigid plastic. The grip portion 106 and/or the joint portion 108 can also comprise a polymer such as a rigid plastic. The grip portion 106 and/or the joint portion 108 can additionally or alternatively comprise wood, metal, or any other suitable material. The components that include the device and the device itself can be manufactured by a variety of means, including injection mold, extrusion process, molds, presses and specialty tooling.

By providing a lever mechanism having a specified angular relationship between the tines 102 and the grip portion 106, embodiments of the invention offer a divot repair tool having an intuitive and/or safer method of application. A user, having gripped the tool 100 and inserted the tines 102 into the ground at the near edge of a divot, will have only one practical way to lever the tool 100—by pulling upwards on the grip portion 106 to push the tines 102 toward the center of the ball mark. Some embodiments thus help to prevent the common mistake of lifting the depression upwards from the center, which is usually the nadir of the ball mark. As noted elsewhere herein, this often tears the roots of the grass, resulting in death of the turf in the area of the ball mark. Further, because the angled handle 104 improves and enhances leverage, the repair action also requires less effort, which can be desirable for many of the reasons explained elsewhere herein. The depicted tool in FIGS. 1A-1D can be used in the methods of repairing a divot, which methods are more fully described elsewhere herein.

Figure 2A:
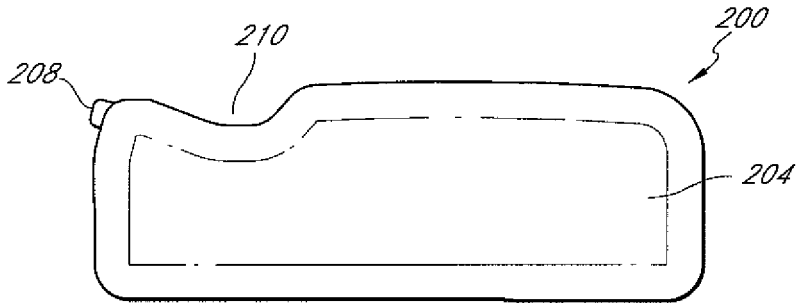
FIG. 2A is a left side view of a divot repair tool according to another embodiment, shown in an inactivated or closed state.
Figure 2B:
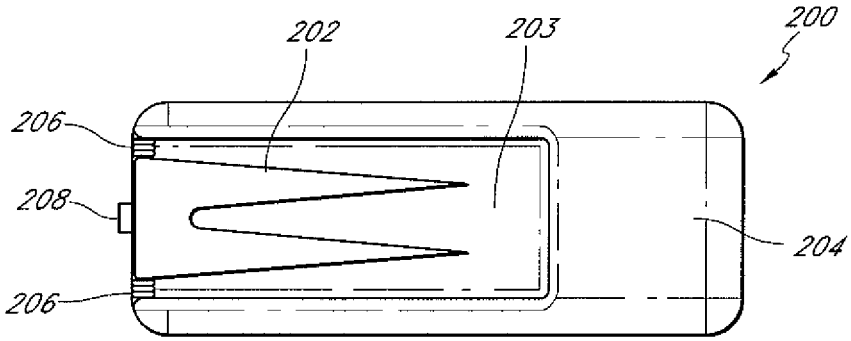
FIG. 2B is a bottom plan view of the divot repair tool of FIG. 2A, shown in an inactivated or closed state.
Figure 2C:
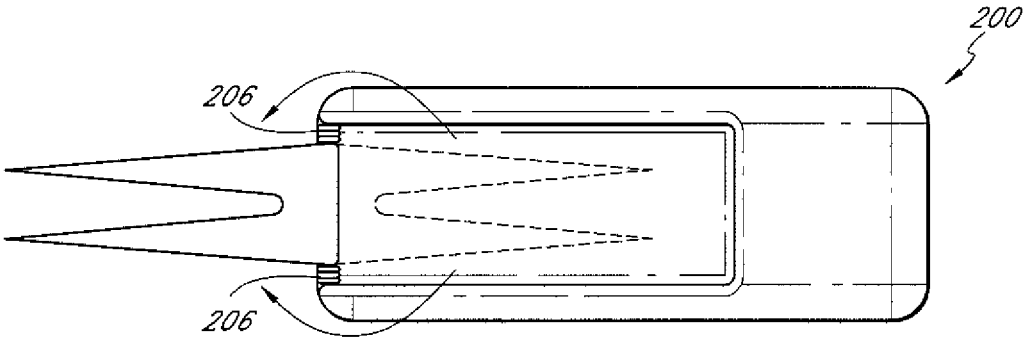
FIG. 2C is a bottom plan view of the divot repair tool of FIG. 2A, shown in an activated or open state.

With reference now to FIGS. 2A-2C, a divot repair tool 200 according to an alternative embodiment is illustrated. FIG. 2A is a straight side view of tool 200 and FIGS. 2B-2C provide a straight view of the undercarriage of tool 200. The tool 200 includes a blade member 202 coupled to a handle 204 at a joint 206. The joint, for example, can sometimes function in a hinge-like manner. The blade member 202 can include one or more tines, as described above in connection with FIGS. 1A-1D. The handle 204 can include one or more depressions and/or contours 210 configured to indicate to a user the proper grip of the tool 200, as also described above in connection with FIGS. 1A-1D. In addition, the joint 206 can be configured such that the blade member 202 is movable, with respect to the handle 204, between an inactivated or closed position (see FIGS. 2A and 2B) and an activated or open position (see FIG. 2C). In the closed position, the blade member 202 can lie flush or parallel to the handle 204, or the blade member 202 can lie in a cavity 203 provided in the handle 204, so that the tool can be placed in a user's pocket without the risk of jabbing the user's leg and without the risk of jabbing the user's hand when the user reaches in to retrieve the tool. In the open position, the blade member 202 can be fixed at a specified angle with respect to the handle 204, as described above in connection with FIGS. 1A-1D, so as to encourage the proper insertion and levering of the tool 200 during use. The tool 200 can comprise snap-fit, latching, hinging, torsion springs, pins and rods, other locking means or any combination thereof to releasably fix the tool 200 in the open and closed positions. For example, a spring could place tension on a locking bar or pin to hold the blade member in place. When the locking bar, or pin holding it, is released, the blade member could move to the desired open or closed position. The tool 200 can further include activation means for activating the joint 206, such as a clip or a pivot button 208, which can be configured to release the blade member 202 from a closed position. The joint 206 can comprise a hinge or any other mechanism by which the blade member 202 can be pivotably (or otherwise movably) coupled to the handle 204. With reference to FIG. 2C, the joint 206 can be configured to flip open and closed in a clamshell configuration (that is, into and out of the page). In such a configuration, the blade member 202 can be about the same length as the handle 204, or can be shorter or longer than the handle 204. Alternatively, the blade member 202 can be configured to pivot about a pivot point of the handle 204 (that is, generally within the plane of the page). Embodiments of the tool 200 can be, for example, at least 1.5 inches in length, 0.75 inches in width and/or 0.5 inches in height. In the open position, the blade member 202 can be fixed at a specified angle with respect to the handle 204 as described in connection with other tools herein so as to encourage the proper insertion and levering of the tool 200 during use. The depicted tool in FIGS. 2A-2C can be assigned designs, logos, text, trademarks, colors, themes and be used in the methods of repairing a divot, which methods are more fully described elsewhere herein.

Figure 3A:
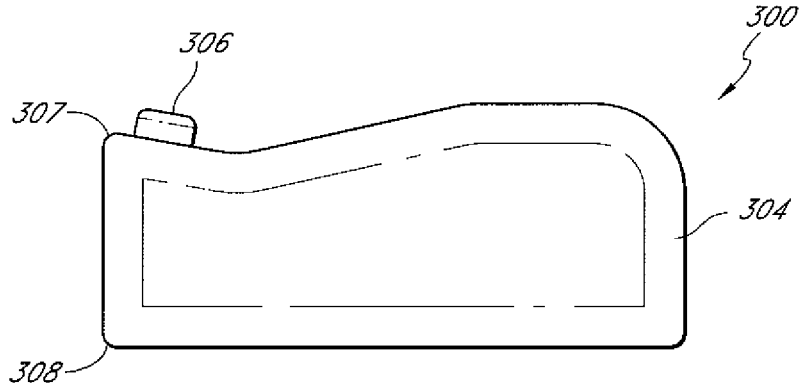
FIG. 3A is a left side view of a divot repair tool according to a further embodiment, shown in an inactivated or closed state.
Figure 3B:
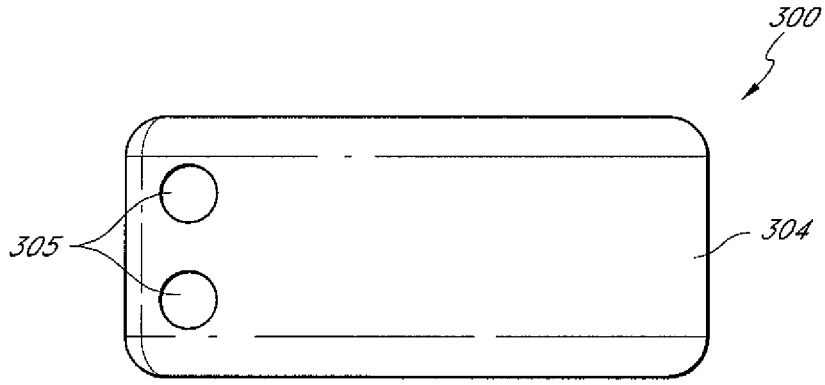
FIG. 3B is a bottom plan view of the divot repair tool of FIG. 3A, shown in an inactivated or closed state.
Figure 3C:
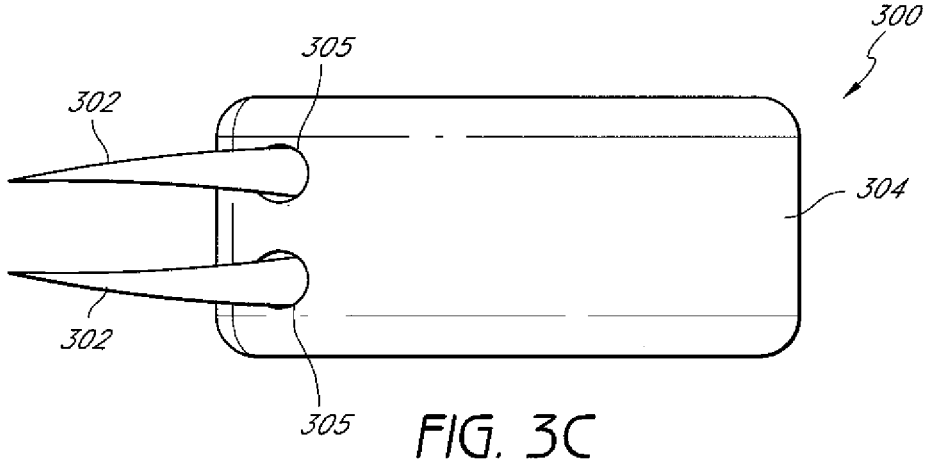
FIG. 3C is a bottom plan view of the divot repair tool of FIG. 3A, shown in an activated or open state.

With reference now to FIGS. 3A-3C, a divot repair tool 300 according to another alternative embodiment is illustrated. FIG. 3A is a straight side view of tool 300. FIGS. 3A-3B show a straight view of the undercarriage of tool 300. The tool 300 includes tines 302 which, in a closed or inactivated position, are housed entirely within a handle 304 or such other encasement. Although in some aspects, the blade member or tines can be partially housed in the cavity. The tool 300 also includes an activation button 306 located on its top 307 side of the handle. The activation mechanism 306 may be a spring-loaded button configured to release the tines 302 from a retracted position and into an open or activated position (see FIG. 3C). In the activated position, the tines 302 are fixed at a specified angle with respect to the handle 304, as described above in connection with FIGS. 1A-1D, so as to encourage the proper insertion and levering of the tool 300 during use. The tines can be straight, curved, angled, or the like. For example, they can be curved when imbedded in the device's housing and, when released, extended from the main body of the device in a curved, but fixed, position. It should be noted and understood that the tines as a component in any of the embodiments, can be, for example, linked or joined in one piece, or they can be separate individual "posts" or rods made of various metals or plastics, or any other suitable material. In the example of tool 300, the tines deploy and retract via eyehole style openings 305, located on the bottom, or undercarriage, of the tool, near the point 308. The eyehole openings 305 are two separate openings from which the tines 302 can deploy and retract. In some other embodiments of the tool, the tines or blade member projects from, and retracts to, a single large opening on one end of the tool, which opening is large enough to permit passage of the tines and/or blade. In the open position, the blade member 302 can be fixed at a specified angle with respect to the handle 304 as described in connection with other tools herein so as to encourage the proper insertion and levering of the tool 300 during use.

FIGS. 3A-3C depict one example of a device with "deployable" tines. Many other configurations can be utilized having "deployable" tines. Deployable tines can include those that can be retracted, contracted, activated, released, deployed or otherwise manipulated to expose or conceal the tines from a cavity in the device's housing. Deployment can be accomplished via any suitable activation mechanism (e.g., button, lever, spring, clasp, hinge, etc.). In some aspects that comprise a device with deployable tines, the housing can take many shapes that conceal the tines when in a stored state, but once deployed will comfortably serve as the handle to implement the device, providing leverage to the user as the activated tines angle to fix the ball mark. The activation button, or mechanism that deploys the tines, can be located on the top, bottom, or sides of the embodiment in various design. Furthermore, in the deployable "switch-blade" embodiment of the device, the embedded tines can be activated via a spring loaded mechanism, retractable lever, rotating gear mechanism, pin and rod system, a combination of similar methods or any other suitable mechanism. In embodiments where the tines are embedded and then deployed via an activation mechanism, the device can store easily in the pocket of the user when the tines are contracted. Also, in some aspects related to devices having retractable tines, some devices can include bristles, or scrapers, integrated into the design at the eye-holes, or cavities, where the tines contract and deploy in order to keep the tines clean and free of grass, sand and dirt debris. Other design elements to assist in cleaning the deployable tines can utilize compartments that open in a clamshell-like manner, for example, to clean the inside of the housing, i.e. its cavity, where the tines are stored and deployed. The depicted tool in FIGS. 3A-3C can be of similar dimensions to other embodiments described herein and be used in the methods of repairing a divot, which methods are more fully described elsewhere herein.

Figure 4A:
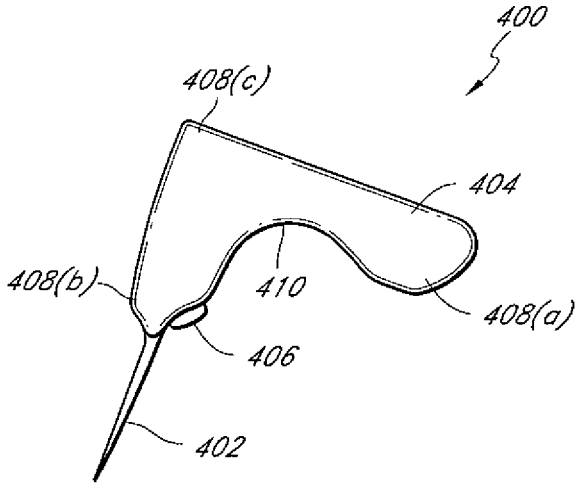
FIG. 4A is a left side view of a divot repair tool according to a further embodiment, shown in an activated or open state.

FIG. 4A shows a divot repair tool 400 according to a still further embodiment. The tool 400 includes tines 402 which are operatively coupled to a handle 404. An activation button 406 is provided on the handle 404. The handle 404 includes a cavity (not shown) to house the tines 402 in a position of vertical bias when the tool 400 is in an inactivated or closed position. The activation button can be configured to both release the tines 402 from an inactivated position, and retract the tines 402 from an activated position to an inactivated position inside the cavity. Alternatively, the tool can be configured such that the activation button only releases the tines 402 from the inactivated position, and manual force is required on the tines 402 to move the tines 402 back to the closed position. The activation button 406 can be located on other places of the tool, such as the top, sides, other places on the undercarriage, front or rear. As can be seen in the figure, the handle 404 has a slightly triangular side profile, with a first (or proximal) portion 408(*a*), a second (or distal) portion 408(*b*), and a third portion 408(*c*). The first and second portions 408(*a*), 408(*b*) are disposed at an appropriate angle with respect to the tines 402 such that, when the user grips the handle 404 and approaches the ground with the first and second portions 408(*a*), 408(*b*) roughly in line with the ground, the tines are disposed at an appropriate angle to execute the task of ball mark repair. The third portion 408(*c*) of the handle 404 is configured to house the blade member 402 when the blade member is retracted, resist slippage and provide a secure grip for the user as he or she moves the tool 400 toward the center of a ball mark. A contour 410 is provided between the first and second portions 408(*a*), 408(*b*) and is also configured to provide a secure and intuitive grip for a user, as described above. In the open position, the blade member 402 can be fixed at a specified angle with respect to the handle 404 as described in connection with other tools herein so as to encourage the proper insertion and levering of the tool 400 during use.

Figure 4B:
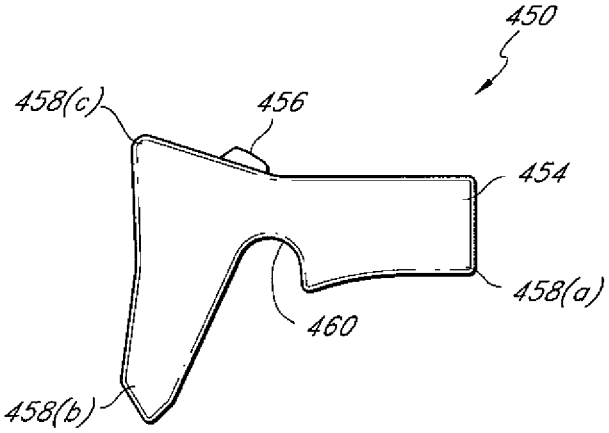
FIG. 4B is a left side view of a divot repair tool according to another embodiment, shown in an inactivated or closed state.

FIG. 4B shows a divot repair tool 450 according to another embodiment, shown in a retracted or closed position. The tool 450 includes tines (not shown), which are operatively coupled to a handle 454. An activation button 456 is provided on the handle 404. The activation button can be configured to both release the tines from the retracted position and contract them to a concealed position inside the tool's housing. As can be seen in the figure, the handle 454 has a slightly triangular side profile, with a first (or proximal) portion 458(*a*), a second (or distal) portion 458(*b*), and a third portion 458(*c*). The first and second portions 458(*a*), 458(*b*) are disposed roughly at an appropriate angle with respect to the tines to provide an intuitive grip for proper application of the tool 450. The third portion 458(*c*) of the handle 454 comprises a slight protrusion configured to help house the tines with a vertical bias, resist slippage and provide a secure grip for the user as he or she executes the task of ball mark repair. One or more contours 460 are provided between the first and second portions 458 (*a*), 458(*b*) which are configured to provide a secure and intuitive grip for a user. The activation button is provided between the first portion 458(*a*) and the second portion 458(*c*) and configured to receive a thumb of a user as he or she grips the tool, advantageously providing increased leverage as the user executes the task of ball mark repair. Additional non-limiting configurations of handles and tines are shown in FIGS. 1A-1D, 2A-2C, 3A-3C, 4A-4B, 5A-5B, 6A-6F, 7B, 8A-8C, 9A-9C 10A-10E, 11A-11E, 12A-12D, 13A-13D, 14A-14C, 15A-15C, 16A-16C, 17A-17L, 18A-18C, 19A-19D, 20A-20E and 21A-B. In the open position, the blade member (not shown) of tool 450 can be fixed at a specified angle with respect to the handle 454 as described in connection with other tools herein so as to encourage the proper insertion and levering of the tool 450 during use. The depicted tool in FIGS. 4A-4B can be of dimensions consistent with other tools described herein and used in the methods of repairing a divot, which methods are more fully described elsewhere herein.

Figure 5A:
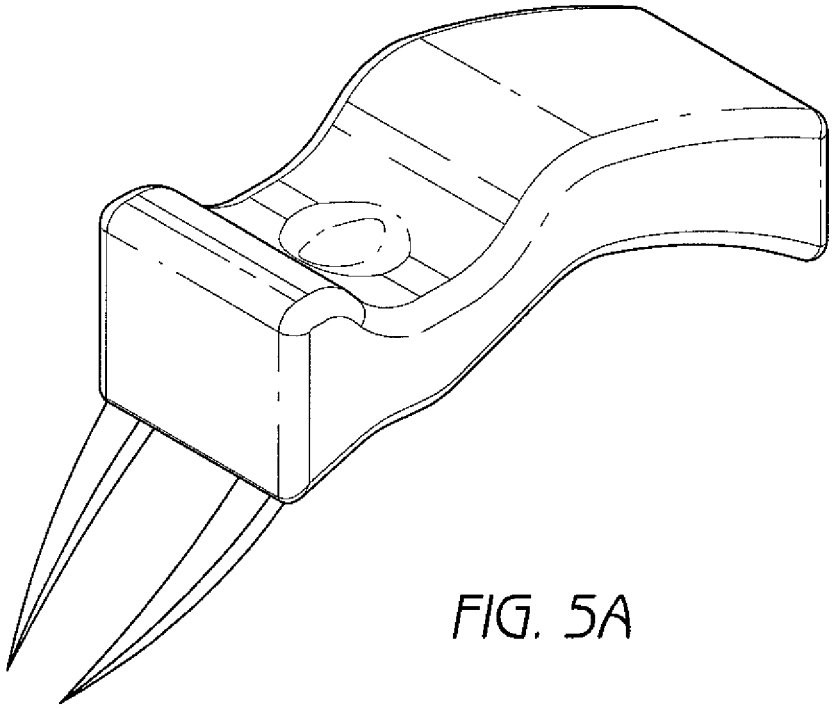
FIG. 5A is a perspective view of a divot repair tool according to a further embodiment.
Figure 5B:
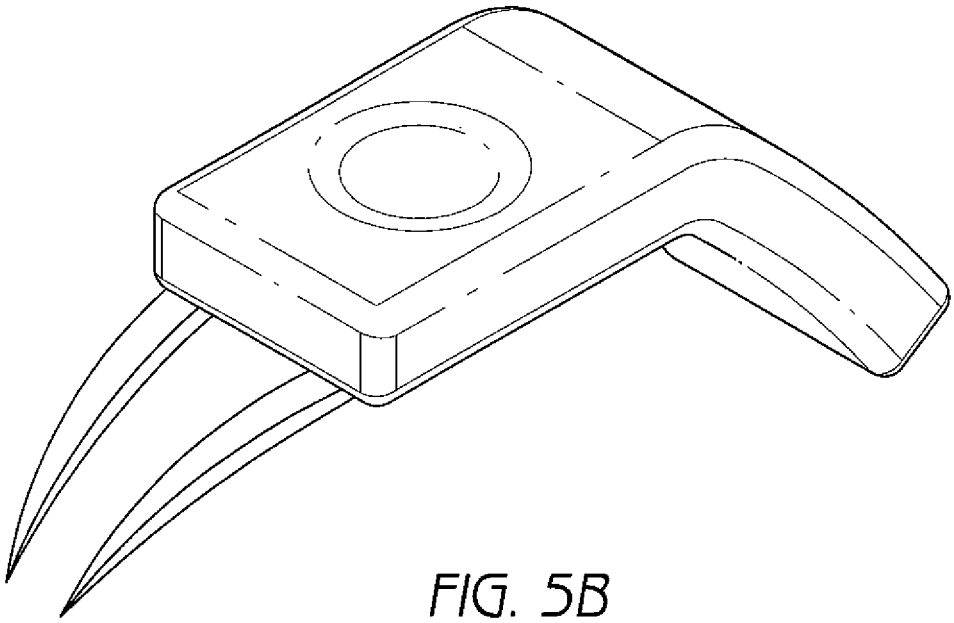
FIG. 5B is a perspective view of a divot repair tool according to still another embodiment.

FIGS. 5A-B illustrate two divot repair tools. FIG. 5A has straight tines and contours on both the top side and undercarriage of the handle to facilitate gripping the tool. FIG. 5B has tines that curve back towards the device and only one bend in the handle. Tools can have any combination of handle contours and tines that bend in any direction or are simply straight at an angle advantageous to repairing a ball mark. The depicted tool in FIGS. 5A-5B can be used in the methods of repairing a divot, which methods are more fully described elsewhere herein.

Figure 6A:
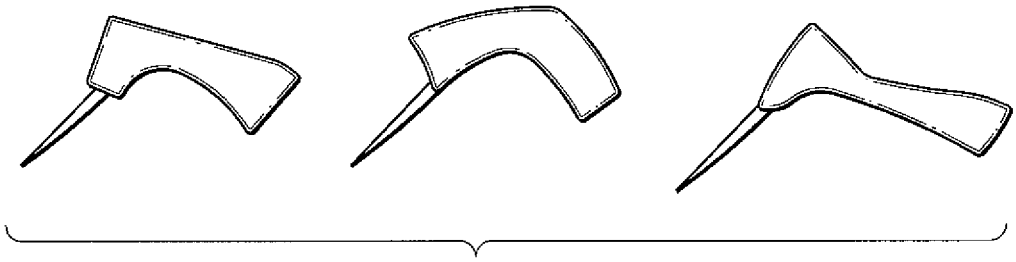
FIG. 6A is an illustration showing side views of various embodiments illustrating handles of various shapes and sizes.
Figure 6B:
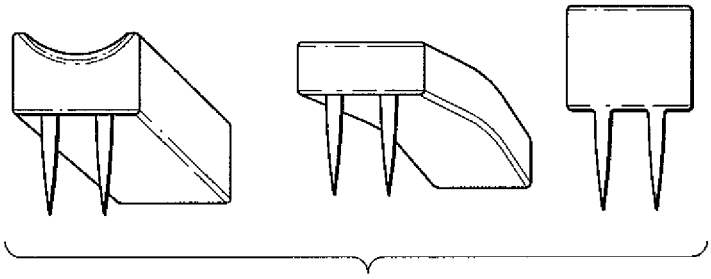
FIG. 6B is an illustration showing front views of various embodiments of the tool.
Figure 6C:
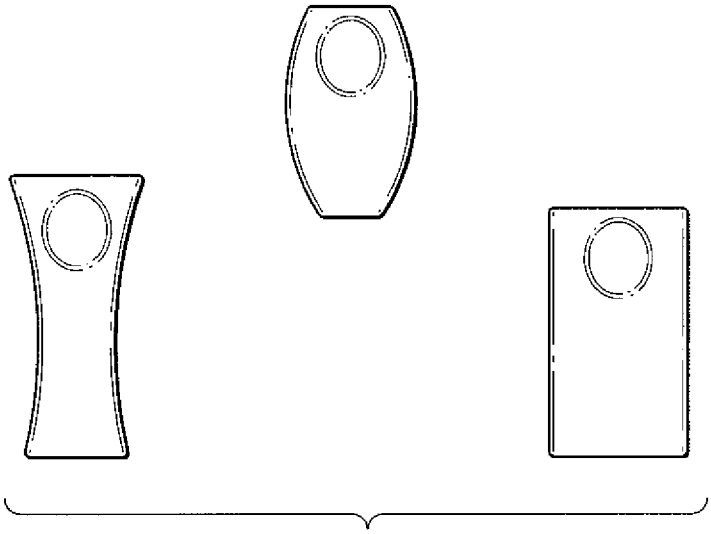
FIG. 6C is an illustration showing top views of the various embodiments.
Figure 6D:
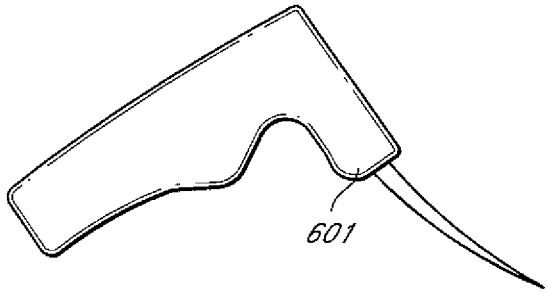
FIG. 6D is an illustration showing a side perspective view of a divot repair tool.
Figure 6E:
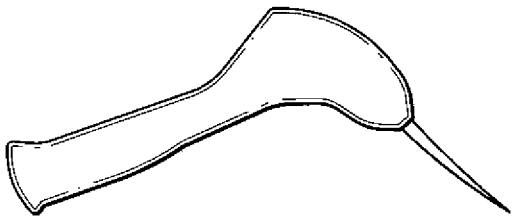
FIG. 6E is an illustration showing a side perspective view of a divot repair tool.
Figure 6F:
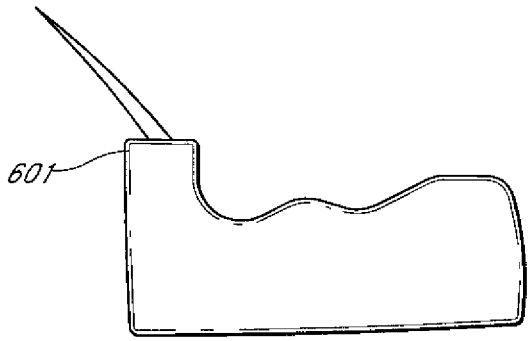
FIG. 6F is an illustration showing a side view of a divot repair tool lying on its back.

FIGS. 6A-6F illustrate divot repair tools according to various additional embodiments. FIG. 6A shows several embodiments having handles of varying sizes and shapes. FIG. 6B shows front views of these embodiments and illustrates that the front of the tool handles can have any suitable shape, including square, rectangular, or curved. The fronts of the handles (see FIG. 6B) as well as tops of the handles, including the thumb depressions (see FIG. 6C) and sides can also display logos, images or insignias for advertising or design purposes. FIG. 6D shows a side view of an embodiment to illustrate the contoured undercarriage of the handle and curved tines in this embodiment. FIG. 6E shows an embodiment, for example, where the straight tines could retract directly back into a cavity located within the housing of the handle. When retracted, the tines are fully obscured in the device's housing. FIG. 6F shows a bottom view of an example of a divot repair tool. The depicted tool in FIGS. 6A-6F can be used in the methods of repairing a divot, which methods are more fully described elsewhere herein.

In some aspects, the devices can have a broad, blunt surface that surrounds the area where the tines protrude, or extend, from the housing, or handle. Such configurations can brace the device against the ground when the tines are inserted into the turf at their full length (or close to it). Such configurations also can assist the device in moving turf when repairing ball marks. The broad, blunt shape can be rounded, flat, or angled. It can cover the area in front of the tines, the area between the tines, the area to the side of the tines and the area behind the tines, which is located closest to the index finger when the device is handled properly. The broad, blunt surface can be an aesthetically pleasing form and can be angled in relation to the direction that the tines will enter the affected area of turf. FIGS. 6D and 6F are examples of tools that have a broad blunt area 601 at the top of the tines.

Figure 8A:
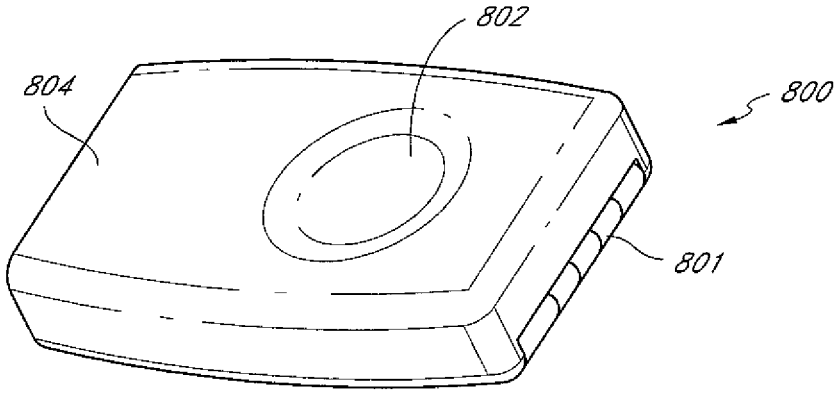
FIGS. 8A-C depict an example of divot repair tool with a hinge or "flip" configuration.
Figure 8B:
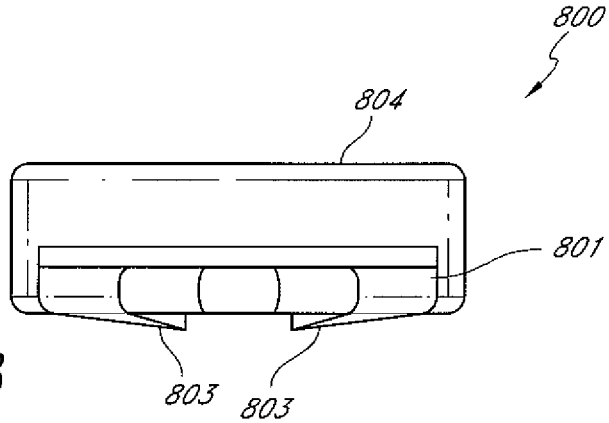
Figure 8C:
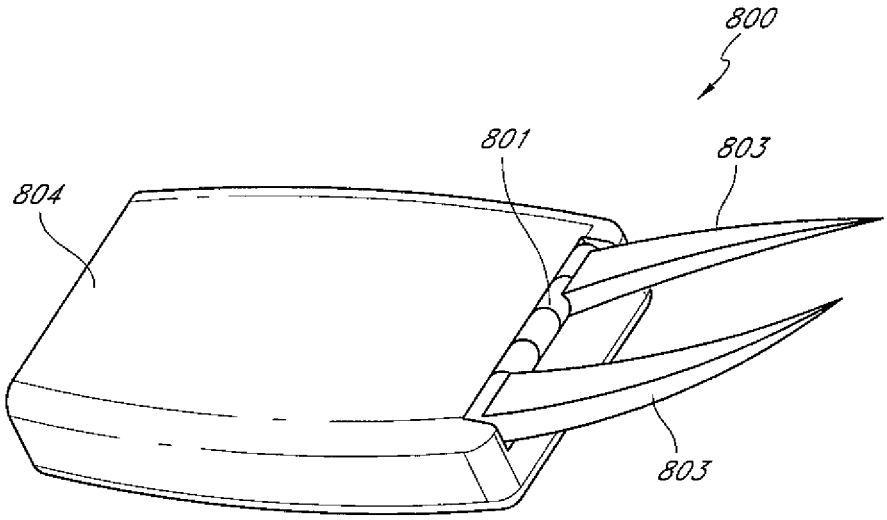

In some embodiments the divot repair tools can be configured with a hinge or flip configuration. For example, a hinge or other mechanism that can rotate or flip to permit deployment or use of the tines can be included on a repair tool. The hinge or "flip" mechanism can permit the times to fold up or close when not in use and to deploy, fold open or flip open when in use. For example, in FIGS. 8A-C the hinge mechanism 801 of tool 800 can be one similar to those used with mobile phones that fold or flip open. Another means of hinging could be where a spring places tension on the blade member 803 to release them from a closed position while a torsion spring places pressure on a locking bar or pin to hold the blade member in place for use. The bar or pin could then be manipulated to release the tines and allow the spring to recoil, returning the blade member to its place of storage. FIG. 8A depicts the top view of the repair tool 800 with the tines retracted or closed with a thumb depression 802 in the handle or main body 804. FIG. 8B depicts the front view of tool 800 with the tines 803 closed or folded. FIG. 8C depicts a view of the tool 800's undercarriage with the tines deployed or flipped open. In some embodiments, there can be an external cavity to conceal and store the tines. These and other embodiments can be of any suitable length, width, height, etc. In some embodiments the device can be, for example, at least 1.5 inches in length, at least 0.75 inch in width and/or at least 0.5 of an inch in height as measured when lying on a flat surface such as a table with the undercarriage flush to the surface. In the open position, the blade member 803 can be fixed at a specified angle with respect to the handle/housing 804 as described in connection with other tools herein so as to encourage the proper insertion and levering of the tool 800 during use.

Figure 9A:
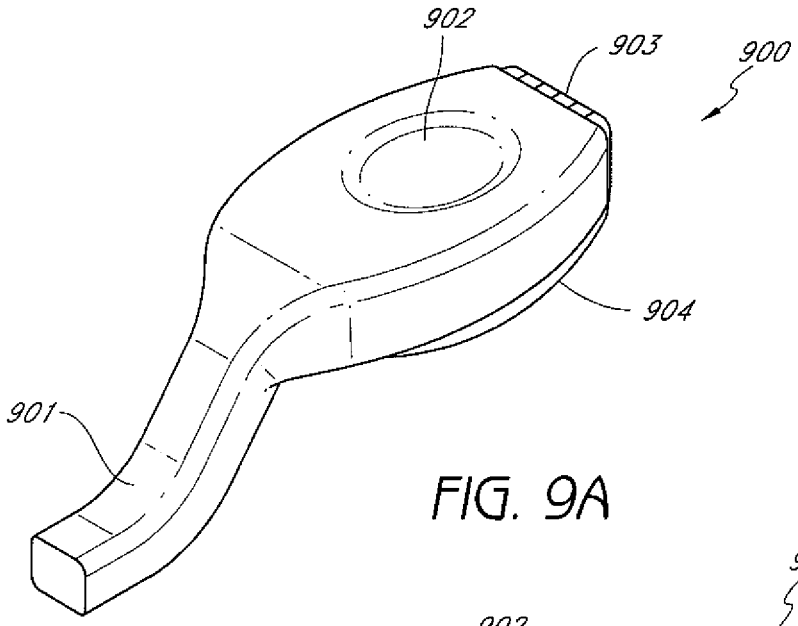
FIGS. 9A-C depict another example of a hinge or "flip" configuration.
Figure 9B:
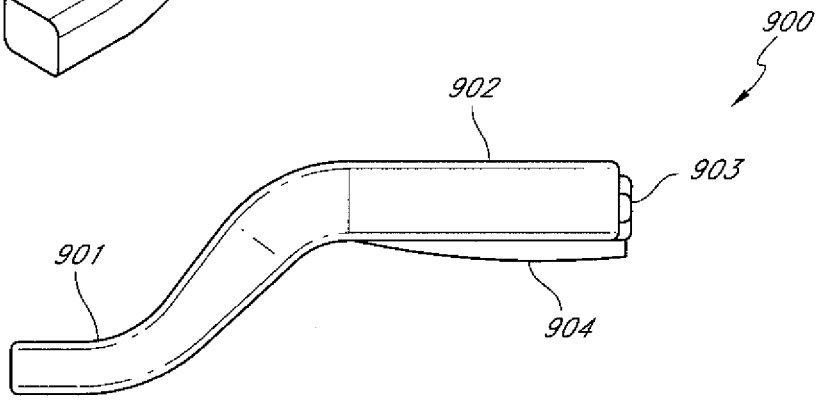
Figure 9C:
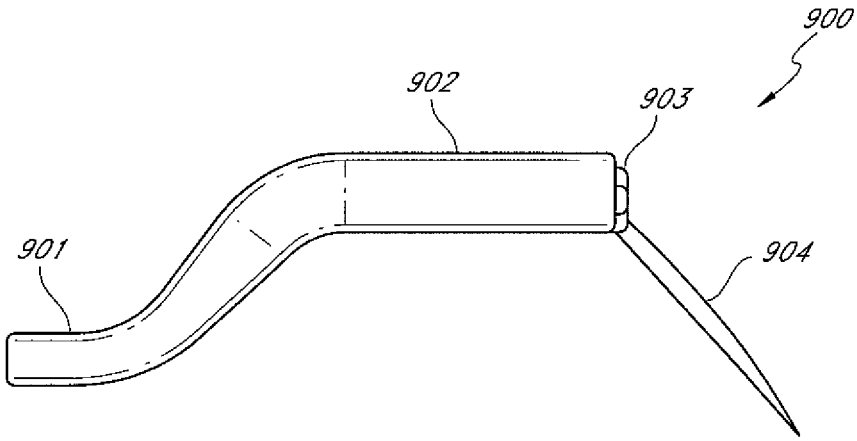
Figure 10A:
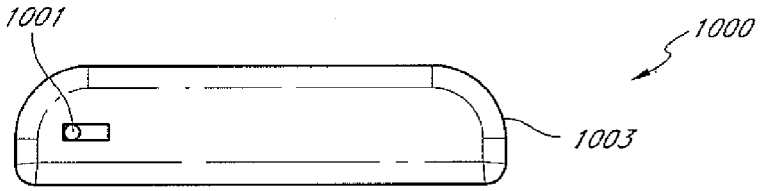
FIGS. 10A-E depict another example of a hinge or "flip" configuration.
Figure 10B:
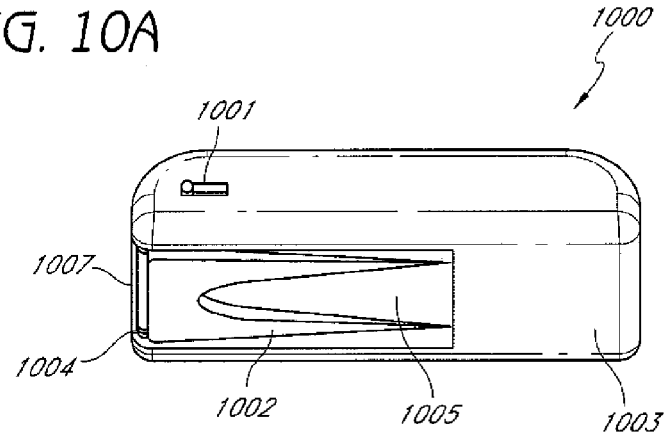
Figure 10C:
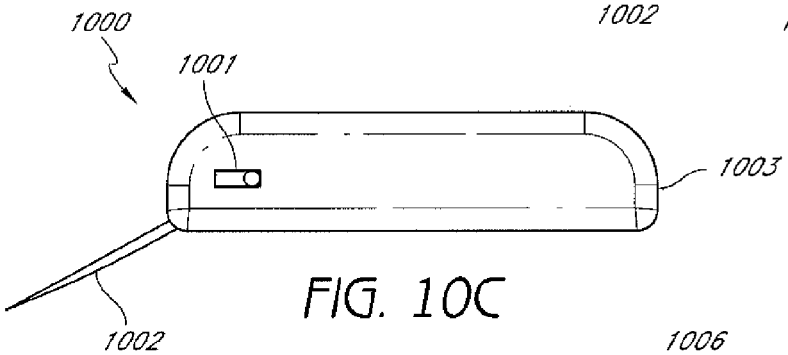
Figure 10D:
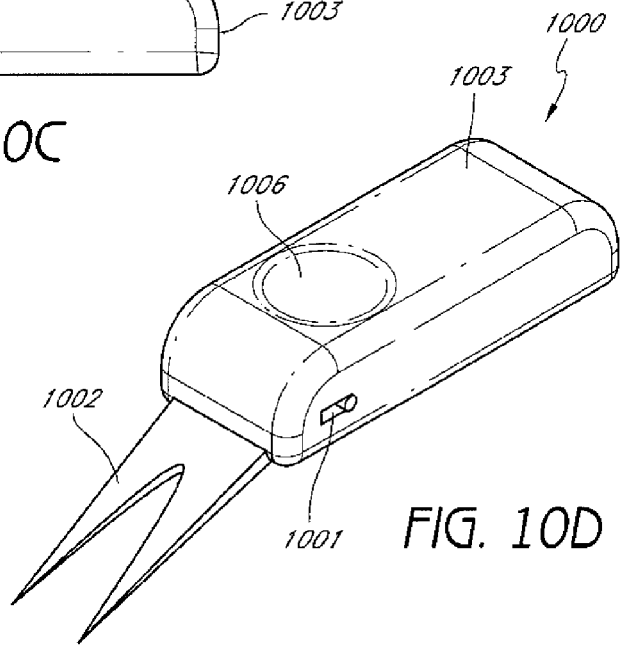
Figure 10E:
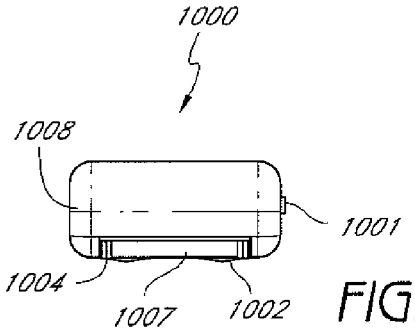

FIGS. 9A-9C depict another example of a divot repair tool 900 with a top view (FIG. 9A) and two side views (FIGS. 9B-9C). The tool 900 has a thumb depression 902 at the top of the handle 901, a blade member 904 and a hinge 903 to assist in the art of ball mark repair. In the open position, the blade member 904 can be fixed at a specified angle with respect to the handle 901 as described in connection with other tools herein so as to encourage the proper insertion and levering of the tool 900 during use. The depicted tool in FIGS. 6A-6F, 8A-8C and 9A-9C can be used in the methods of repairing a divot, which methods are more fully described elsewhere herein.

FIGS. 10A-10E show a divot repair tool 1000 according to another embodiment. The tool 1000 includes a blade member 1002 that is coupled to a handle 1003 at a hinge 1004. The handle 1003 can include a thumb depression 1006 configured to indicate to a user the proper grip of the tool 1000 to repair a ball mark. The hinge 1004 can be configured so that the blade member 1002 is movable with respect to the handle 1003 between an inactivated or closed position (see FIGS. 10A, 10B and 10E) and an open or activated position (10C-10D). In the closed position, the blade member 1002 can lie in a cavity 1005 provided in the undercarriage of the handle so that the tool can be placed in a user's pocket without jabbing the person's leg or body. The tool 1000 has a notch or gap 1007 located on the lower part of the tool's front face 1008 that allows the blade member to swing out to the desired angle of insertion. This notch or gap can extend all the way to the sides of the handle in some embodiments or be defined within the width of the tool in others. The tool 1000 can be activated and deactivated by a button 1001 located on the left side of the device that could be tension driven by a spring, or similar mechanism. The tool 1000 can also include, for example, locking/unlocking and activation/deactivation mechanisms as described earlier in connection with FIGS. 2A-2C. In other embodiments, the activation mechanism can be located elsewhere on the tool and can be mechanically driven by a different release and retract systems. Again, these and the other tools described herein can be of any suitable size. For example, these and other embodiments can be at least 1.5 inches in length, at least 0.75 inch in width and/or at least 0.5 of an inch in height as measured in the closed position when lying on a flat surface with the undercarriage flush to the surface. Generally, in some embodiments the tools described herein are of a size that does not exceed the size of a user's hand or at least not exceed the size of a user's hand by more than 1-3 inches, for example. In the open position, the blade member 1002 can be fixed at a specified angle with respect to the handle 1003 as described in connection with other tools herein so as to encourage the proper insertion and levering of the tool 1000 during use. The depicted tool in FIGS. 10A-10E can be used in the methods of repairing a divot, which methods are more fully described elsewhere herein.

Figure 11A:
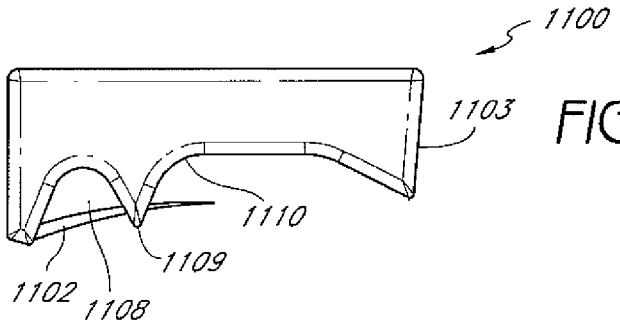
FIGS. 11A-E depict another example of a hinge or "flip" configuration.
Figure 11B:
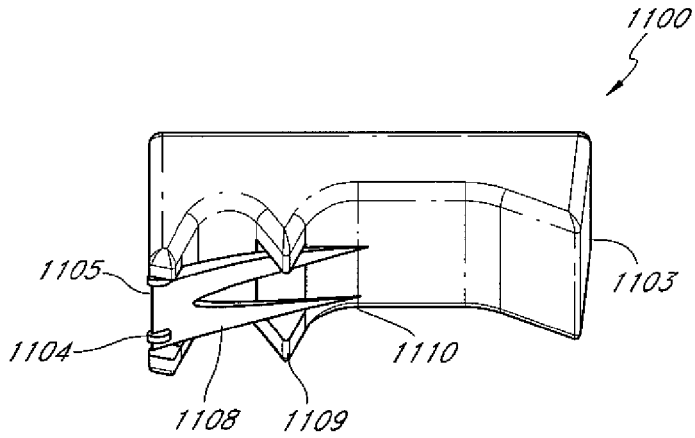
Figure 11C:
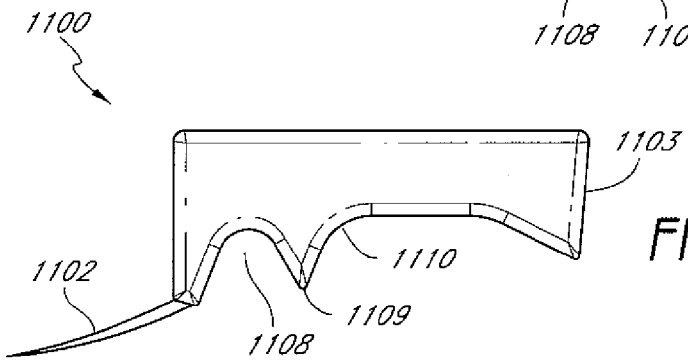
Figure 11D:
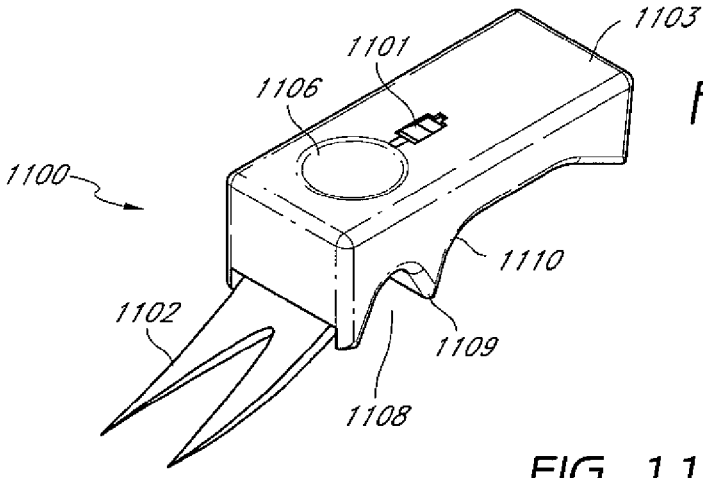
Figure 11E:
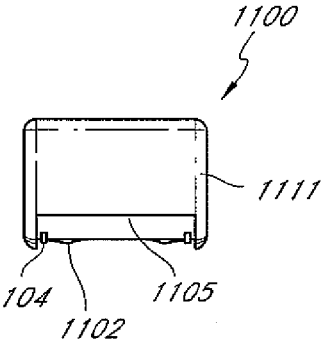

FIGS. 11A-11E show a divot repair tool 1100 according to a still further embodiment. The tool 1100 comprises a blade member 1102 that is coupled to a handle 1103 at a hinge 1104. The handle 1103 can include a thumb depression 1106 and contours 1108/1110 configured to indicate to a user the proper grip of the tool 1100 to repair a ball mark. The point 1109 on the undercarriage between contours 1108 and 1110 helps offset and secure the index finger from the rest of the hand in supporting the tool 1100 in ball mark repair. The hinge 1104 can be configured so that the blade member 1102 is movable with respect to the handle 1103 between an inactivated or closed position (see FIGS. 11A, 11B and 11E) and an open or activated position (11C-11D). In the closed position, the blade member 1102 can lie in a cavity 1105 cut into the contours provided in the undercarriage of the handle (see FIG. 11B). In other words, the contours 1108/1110 of the undercarriage can feature channels, or grooved depressions so that the blade member can be stored lying within the said channel or said grooved depressions so that the tool can be placed in a user's pocket without jabbing the person's leg or body. In FIG. 11E, the tool 1100 has a notch or gap 1105 located on the lower part of the front face 1111 of tool 1100 to allow the blade member to swing out to the desired angle of insertion. This notch or gap can extend all the way to the sides of the handle in some embodiments or be defined within the width of the tool in others. In FIG. 11D, the tool 1100 can be activated and deactivated by a button 1101 located on the top side of the tool that could be tension driven by a spring or similar mechanism. The tool 1100 can also comprise locking/unlocking and activation/deactivation mechanisms and some size dimensions as described earlier in connection with FIGS. 10A-10E. In the open position, the blade member 1102 can be fixed at a specified angle with respect to the handle 1103 as described in connection with other tools herein so as to encourage the proper insertion and levering of the tool 1100 during use. The depicted tool in FIGS. 11A-11E can be used in the methods of repairing a divot, which methods are more fully described elsewhere herein.

Figure 12A:
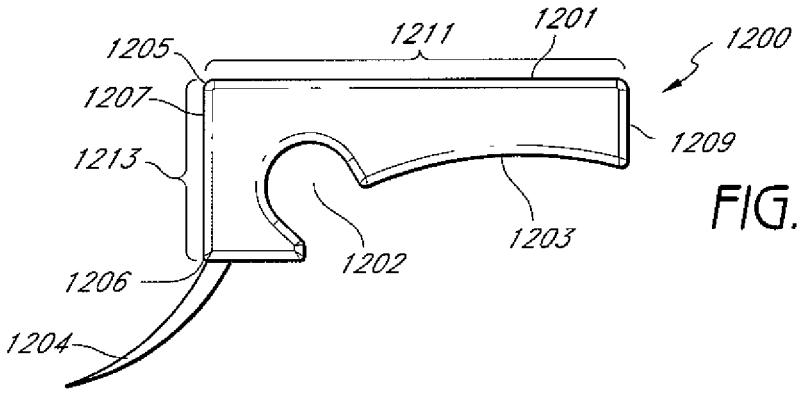
FIGS. 12A-D depict an example of a divot repair tool according to an embodiment.
Figure 12B:
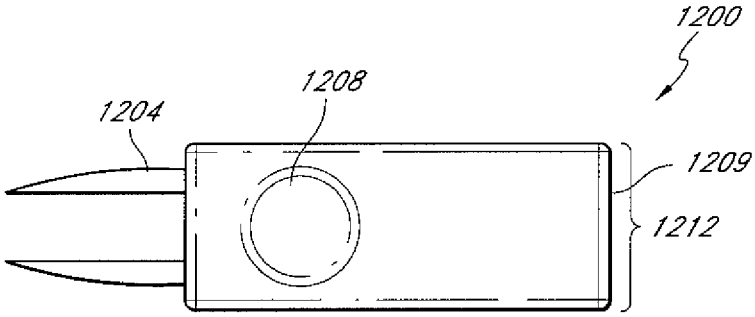
Figure 12C:
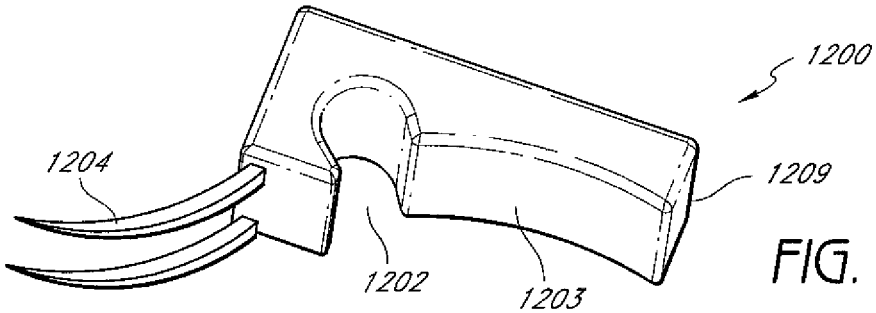
Figure 12D:
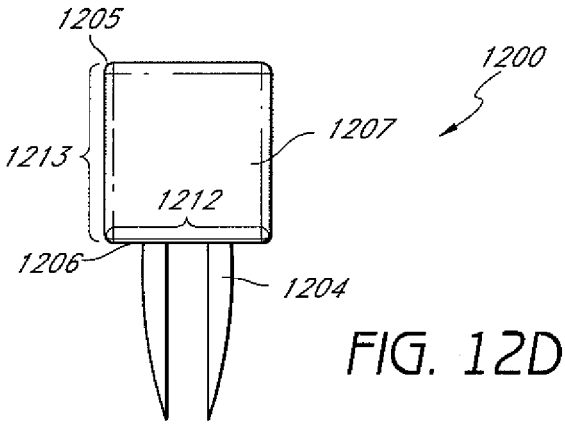
Figure 13A:
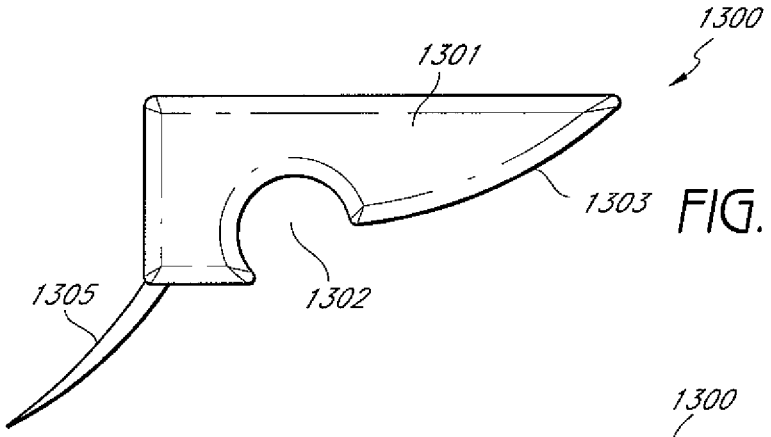
FIGS. 13A-D depict an example of a divot repair tool according to an embodiment.
Figure 13B:
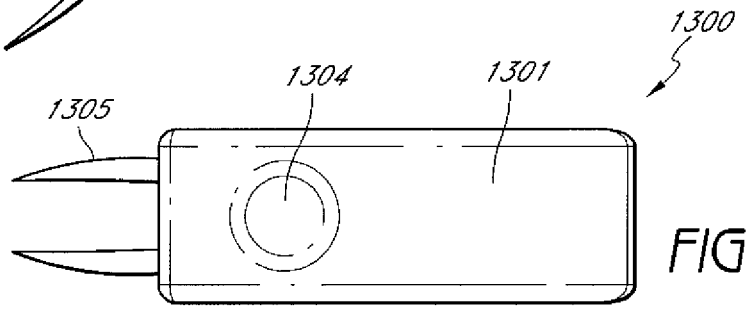
Figure 13C:
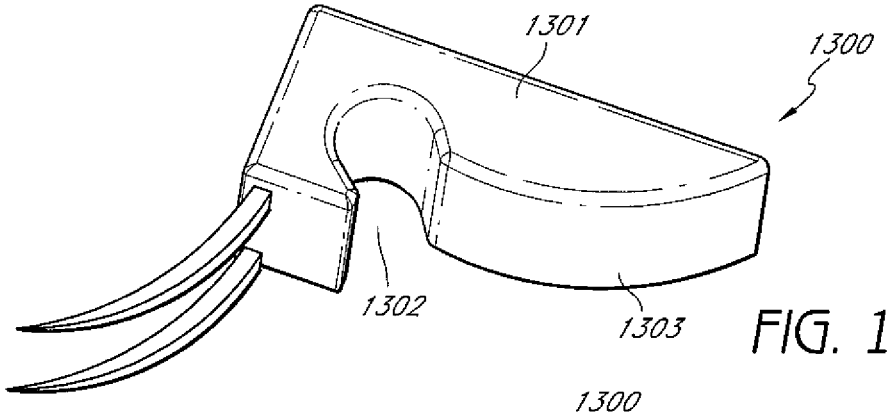
Figure 13D:
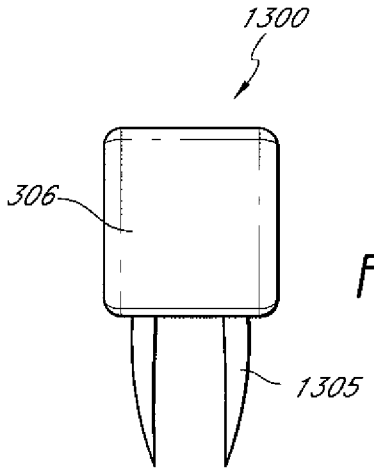

FIGS. 12A-12D shows a divot repair tool 1200 according to a still further embodiment. FIG. 12A shows that tool 1200 has a handle 1201 of approximately 2.5 inches in length 1211, 1 inch in width 1212 and 1 inch in height 1213 (as measured from points 1205 to 1206). These dimensions could, in some embodiments, be altered. Tool 1200 has a handle 1201 with a notch 1202 and shapely contour 1203 on the undercarriage that facilitates a secure gripping of the tool in use. Curved tines 1204 extend from the tool, but the tines could also be flat or straight in other embodiments. As in other tools, the tines are set at an angle advantageous to ball mark repair. FIG. 12B shows a top view with a depression 1208 for thumb placement. FIG. 12C shows a notch 1202 on the undercarriage for the index finger and shapely contour 1203 for placement of the middle, ring and pinky fingers. The thumb depression 1208 and undercarriage contours allow users to put effective pressure on opposite sides of the handle when handling the tool. For example, the thumb applies downward pressure on the depression 2008 while the index finger goes in the slot 1202 and middle finger, ring finger and pinky wrap around the undercarriage contour 1203 and apply simultaneous upward pressure. This allows the user to squeeze the handle and effectively manipulate it for divot repair. After the user has applied tool 1200 to agitate affected turf, the user can either apply the rear 1209 or front face 1207 of the tool to tamp or press down the turf to further smooth the surface, if necessary. Like many other embodiments, tool 1200 has ample space for the application of a logo, design, artwork, text or combination thereof. For example, in FIG. 12D, the front face 1207 could feature a logo. The depicted tool in FIGS. 12A-12D can be used in the methods of repairing a divot, which methods are more fully described elsewhere herein.

FIGS. 13A-13D show a divot repair tool 1300 according to a still further embodiment. The tool 1300 has a handle 1301, blade member 1305, a thumb depression 1304, a front face 1306 and can be described as above in connection with FIGS. 12A-12D, except for the rear undercarriage of the handle. The tool 1300 has an undercarriage with a sloped rear portion of the handle that tapers upward 1303 from the index finger notch 1302 to provide another look and feel to the divot repair device, i.e., this handle design might preferably fit some users. The depicted tool in FIGS. 13A-13D can be used in the methods of repairing a divot, which methods are more fully described elsewhere herein.

Figure 14A:
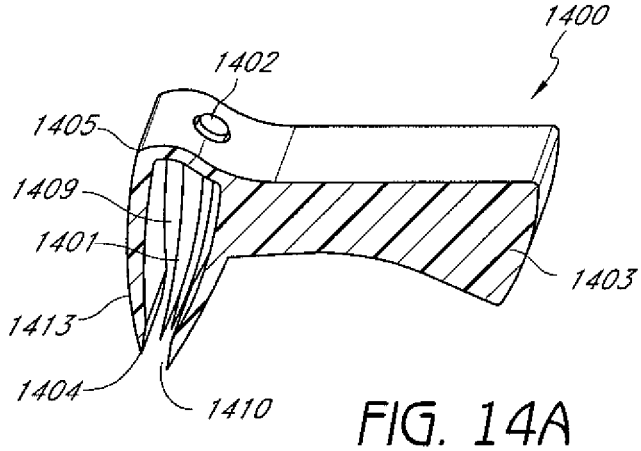
FIGS. 14A-C show a side interior perspective of an embodiment where the tines deploy from and contract back into a housing that also acts as a handle.
Figure 14B:
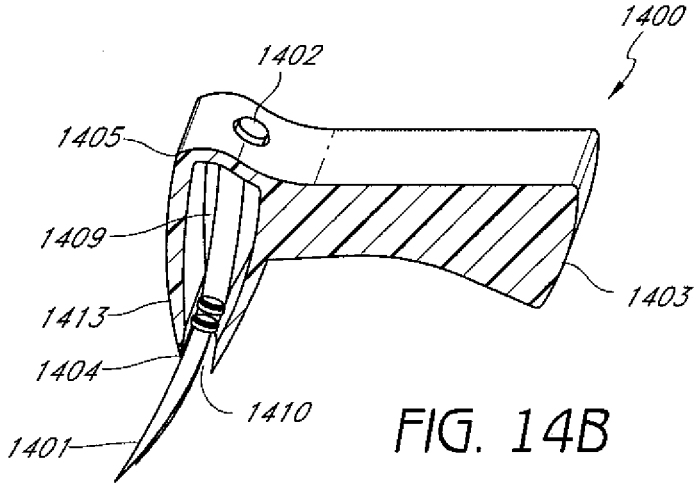

FIGS. 14A-14B show a side interior view of a divot repair tool according to a still further embodiment. The tool 1400 can conceal and deploy a blade member 1401 stored with a vertical bias in a housing's cavity 1409 that is connected to a grip portion that forms a handle 1403. In use, the blade member 1401 deploys from and retracts to the cavity 1409 via the horizontal slot 1410 located below the bottom point 1404 of the tool's front face 1413, which is slightly rounded from its top to bottom (as opposed to rounded from side to side). In these illustrations, the activation/deactivation mechanism 1402 is located on the top side of the tool, but it can appear elsewhere on the tool in other embodiments. Different embodiments of the tool 1400 can have a variety of dimensions consistent with the other tools described herein, with special consideration given to aspects relating to the design dimensions of the housing and cavity within the housing that stores the blade member. The height of the front of tool 1400, the distance from 1404 to 1405, for example, can be at least 1.25 inches and store a blade member of relative size, but the dimensions that relate to the blade member, its cavity and housing can change in other embodiments. FIG. 14A depicts tool 1400 with a stored or concealed blade member 1401. FIG. 14B illustrates tool 1400 with a deployed blade member 1401 that left the cavity 1409 through the horizontal opening 1410. In the open position, the blade member 1401 can be fixed at a specified angle with respect to the handle 1403 as described in connection with other tools herein so as to encourage the proper insertion and levering of the tool 1400 during use. The depicted tool in FIGS. 14A-14B can be used in the methods of activating/deactivating a divot repair tool and used in methods of repairing a divot, which methods are more fully described elsewhere herein.

Figure 14C:
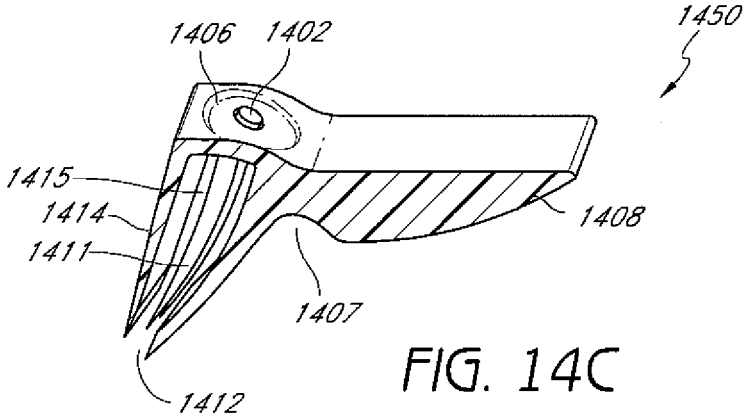

FIG. 14C shows a divot repair tool according to an embodiment, shown in a retracted or closed position. Tool 1450 has a thumb depression 1406 in which the activation mechanism 1402 is situated. The undercarriage of tool 1450 features a notch 1407 for the index finger of the hand when holding the tool. Tool 1450 has a grip portion of the handle where the undercarriage tapers up to its rear 1408 and a flat front face 1414, the bottom of which has an opening 1412 from which the blade member 1411 deploys and then later retracts for storage within the cavity 1415. In contrast to tool 1400, tool 1450 has a slightly different angle of connection between the portion of the tool that houses the blade member 1411 to the supporting grip portion of the handle that extends to its rear. In any embodiment of a tool, the angle of the blade member resting in a cavity and the angle of its housing connected to a grip or handle can vary as can the size dimensions of aspects of the tool itself. In the open position, the blade member 1411 can be fixed at a specified angle with respect to the handle 1408 as described in connection with other tools herein so as to encourage the proper insertion and levering of the tool 1450 during use. The depicted tool in FIG. 14C can be used in the methods of activating/deactivating a divot repair tool and used in methods of repairing a divot, which methods are more fully described elsewhere herein.

Figure 15A:
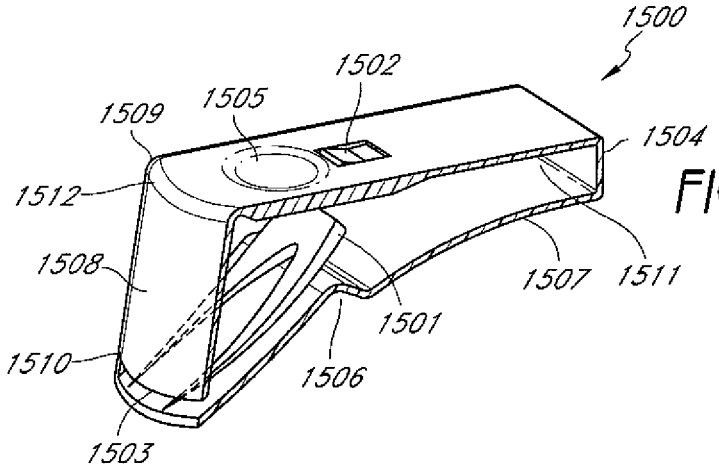
FIGS. 15A-C show a side interior perspective of an embodiment where the tines deploy from and contract back into a housing that also acts as a handle.
Figure 15B:
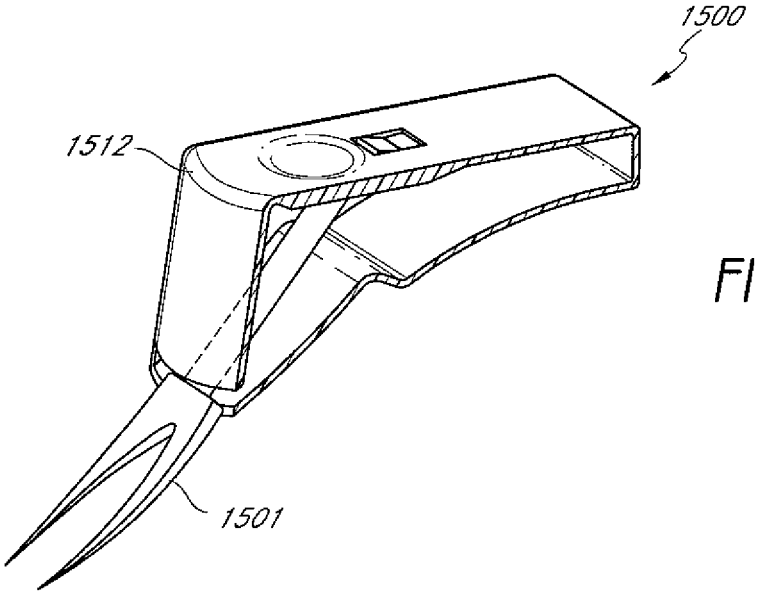

FIGS. 15A-15B show a side interior view of a divot repair tool according to another embodiment. The tool 1500 can conceal and deploy a blade member 1501 via an activation mechanism 1502 through a horizontal opening 1503 located at the bottom of the front face 1508 of the tool's housing 1504. The housing also serves as a handle and can have a thumb depression 1505 on top of the housing 1504 and contours 1506 and 1507 on the undercarriage to comfortably receive the hand for ball mark repair. These contours and the tapered design of the housing 1504 can vary in other embodiments. The tool 1500 and other similar embodiments can be of any suitable size. For example, the tool 1500 and other similar embodiments can have a housing at least 1.5 inches in length, at least 0.75 inch in width and/or at least 0.5 inch in height in the space measured from point 1509 to 1510 (though that is not the measure of the distance in the drawing). The tool 1500 can have a blade member 1501 that it conceals and deploys where the blade member 1501 can feature tines that are curved, flat/straight, tapered or any combination thereof. FIG. 15A illustrates that the blade member 1501 can be stored in the housing's cavity 1511 with a horizontal bias, meaning that the blade member can be retracted or stored at an angle which is horizontal in nature inside the cavity 1511 of the tool's housing 1504. For example, the blade member could be in the cavity at an angle greater than one degree but usually less than forty five degrees. In some aspects, the cavity itself can be constructed to house the necessary working parts of the tool while ensuring the external housing retains the structural integrity necessary to support the task of repetitive ball mark repair and its related activity of transference from pocket to hand and back to pocket. In some embodiments, the angle of the blade member when stored in the cavity differs from the angle of the blade member when deployed for use in ball mark repair because the mechanism that locks the blade member in place can fix it to another angle, for example, via a hinge, pin or similar mechanism. For example, an embodiment could feature torsion springs that put tension on a locking pin, where said pin can activate and deactivate the blade member and/or lock it at an angle advantageous to ball mark repair when it deploys for use. FIG. 15A shows the tool 1500 with the blade member 1501 retracted. FIG. 15B shows the tool 1500 with the blade member 1501 deployed and also that tool 1500 has a rounded front face 1512. In the illustrations 15A-15B, the activation/deactivation mechanism 1502 is located on the top side of the tool's housing 1504, but it can appear elsewhere on the tool in other embodiments. In the open position, the blade member 1501 can be fixed at a specified angle with respect to the handle/housing 1504 as described in connection with other tools herein so as to encourage the proper insertion and levering of the tool 1500 during use. The depicted tool in FIGS. 15A-15B can be used in the methods of activating/deactivating a divot repair tool and used in methods of repairing a divot, which methods are more fully described elsewhere herein.

Figure 15C:
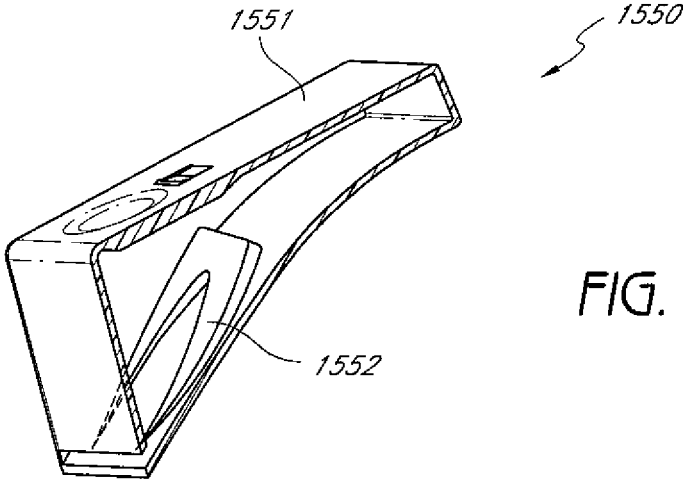

FIG. 15C shows an angled side interior view of a divot repair tool 1550 according to a different embodiment. The tool 1550 is shown with its blade member 1552 stored with a horizontal bias in a retracted or closed position inside the tool's housing 1551. The tool 1550 can be described above in connection with FIGS. 15A-15B except that tool 1550 has slightly different design contours in its undercarriage.

Figure 16A:
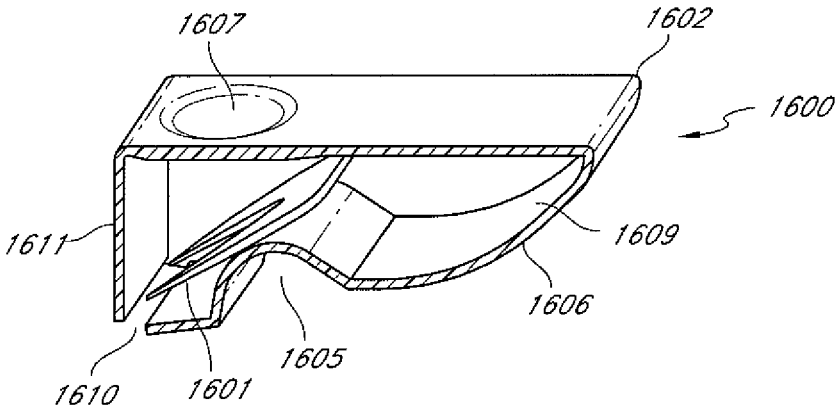
FIGS. 16A-C show a side interior perspective of an embodiment where the tines deploy from and contract back into a housing that also acts as a handle.
Figure 16B:
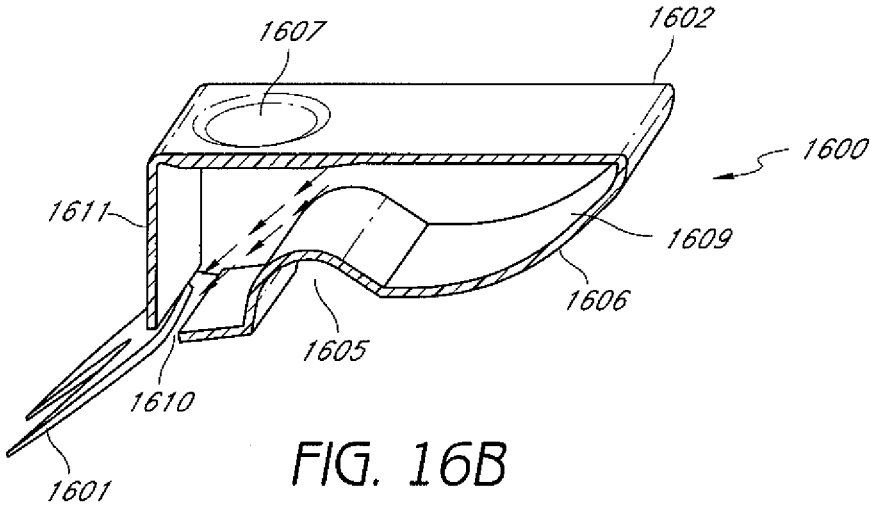

FIGS. 16A-16B show a side interior view of a divot repair tool 1600 according to another embodiment. FIG. 16A shows a blade member 1601 of straight or flat tines resting inside the cavity 1609 in a closed or retracted state. FIG. 16B illustrates that the blade member 1601 has been deployed via a horizontal opening 1610 located on the lower end of the tool's front face 1611. In this embodiment, the blade member 1601 of the tool 1600 exits at the same angle at which it is stored in the cavity 1609. The blade member 1601 can be attached to a rail, channel, groove, track, plate, or similar system that fixes the blade member 1601 to a position relative to the cavity 1609 of the housing 1602. As in other embodiments where the blade member deploys and retracts, the housing 1602 serves as the handle when the blade member 1601 is deployed for ball mark repair. As in other embodiments, the housing 1602 can have contours on the undercarriage such as a notch 1605 for the index finger, a contoured handle 1606 to fit the fingers of the hand as well as a thumb depression 1607. These and other embodiments can be of any suitable size. For example, these and other embodiments can be at least 1.5 inches in length, at least 0.75 inch in width and/or at least 0.5 of an inch in height. In the open position, the blade member 1601 can be fixed at a specified angle with respect to the handle/housing 1602 as described in connection with other tools herein so as to encourage the proper insertion and levering of the tool 1600 during use. The depicted tool in FIGS. 16A-16B can be used in the methods of activating/deactivating a divot repair tool and used in methods of repairing a divot, which methods are more fully described elsewhere herein.

Figure 16C:
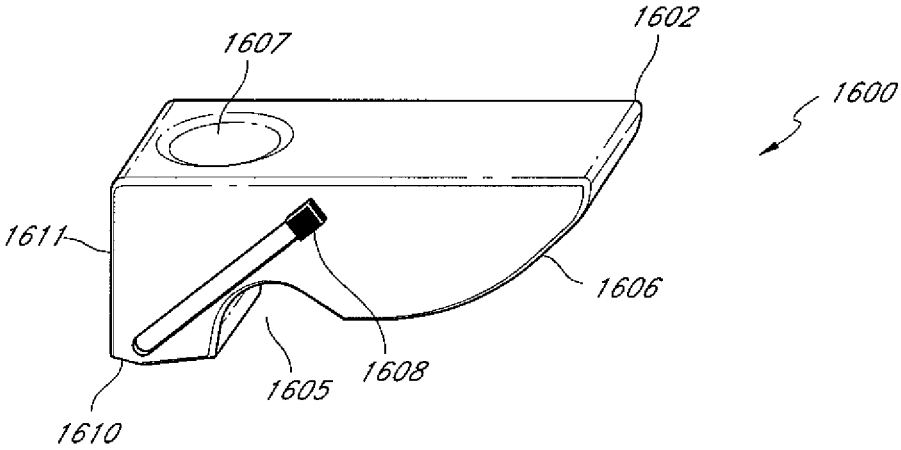

FIG. 16C shows a side exterior view of tool 1600 where the user can deploy the blade member (not shown) out the opening 1610 below the front face 1611 via the activation mechanism 1608 located on the side of the tool. The blade member 1601 can be attached directly to the button 1608, or it can be attached to an intermediary step, such as a spring mechanism, that the button 1608 activates. The depicted tool in FIG. 16C can be used in the methods of activating/deactivating a divot repair tool and used in methods of repairing a divot, which methods are more fully described elsewhere herein.

Figure 17A:
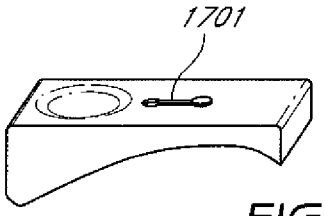
FIGS. 17A-17L show various handle and trigger/button trigger configurations for embodiments with deployable tines.
Figure 17B:
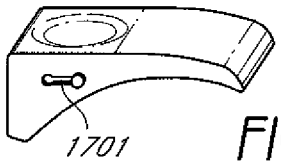
Figure 17C:
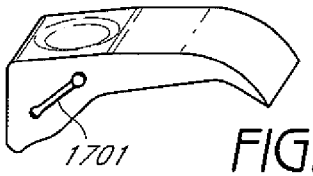
Figure 17D:
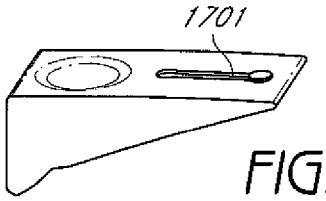
Figure 17E:
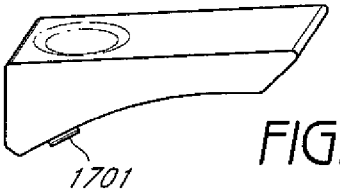
Figure 17F:
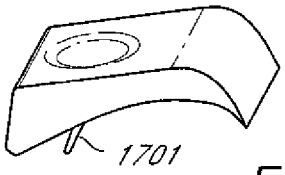
Figure 17G:
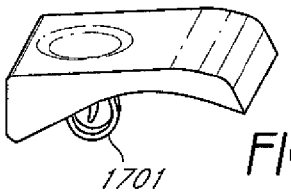
Figure 17H:
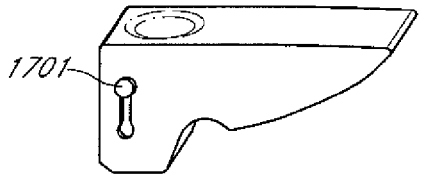
Figure 17I:
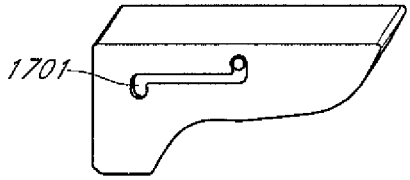
Figure 17J:
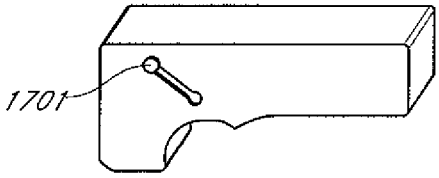
Figure 17K:
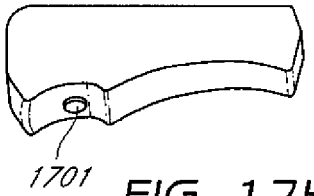
Figure 17L:
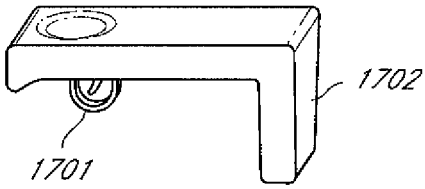

FIGS. 17A-17L show several different design combinations, with respect to the housing/handle and activation/deactivation mechanisms 1701, of deployable blade member tools. The illustrations are shown where the blade members of the tools are in a retracted or closed position and the housings are not necessarily of actual size. FIGS. 17A, 17B, 17C, 17D, 17H, 17I and 17J all have a slide activation mechanism 1701 and FIG. 17E has a push button activation mechanism 1701. FIGS. 17F, 17G and 17L have a trigger type mechanism 1701, where the blade member deploys and retracts to the pull of a trigger. FIG. 17L even features a housing that resembles a pistol. FIG. 17K features a sliding button 1701 located on the undercarriage of the tool that deploys and retracts its blade member. FIGS. 17A, 17B, 17C, 17D, 17E, 17F, 17G and 17H all have thumb depressions on the top of their housings. Like some other embodiments, FIGS. 17I, 17J noticeably do not have thumb depressions. In FIG. 17L, for example, the design of the pistol ball mark repair tool obviates the need for a thumb depression as the tool is gripped by wrapping the hand around the handle 1702. With respect to housings, they can taper upwards or downwards on any of their sides, be flat, thick, thin and every conceivable size and shape to provide the mechanical and other advantages of the tool. The tools can have blade members of all types: angled, curved, tapered, flat/straight and any combination thereof. Further embodiments can mix elements and attributes of the tools depicted here as well as add new features. These and other embodiments can be at least 1.5 inches in length, at least 0.75 inch in width and at least 0.5 of an inch in height. In the open position, the blade member of the tools 17A-17L can be fixed at a specified angle with respect to their respective handles or housings as described in connection with other tools herein so as to encourage the proper insertion and levering of the respective tool during use. The depicted tools in FIGS. 17A-17L can be used in the methods of activating/deactivating a divot repair tool and used in methods of repairing a divot, which methods are more fully described elsewhere herein.

Figure 18A:
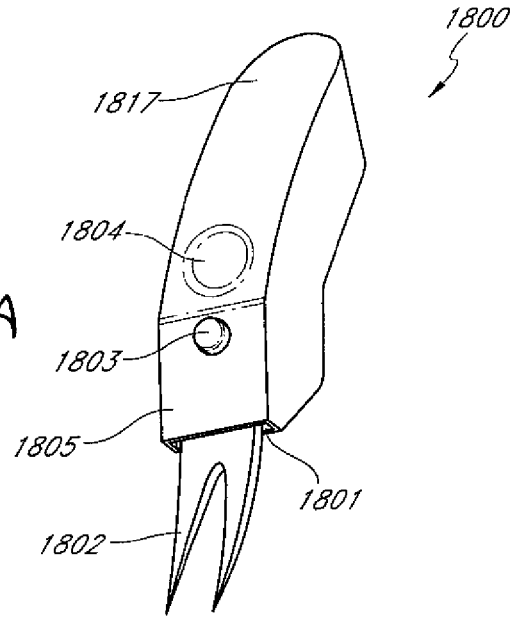
FIGS. 18A-18C show frontal side perspectives of various handle and trigger/button configurations for embodiments with deployable tines.
Figure 18B:
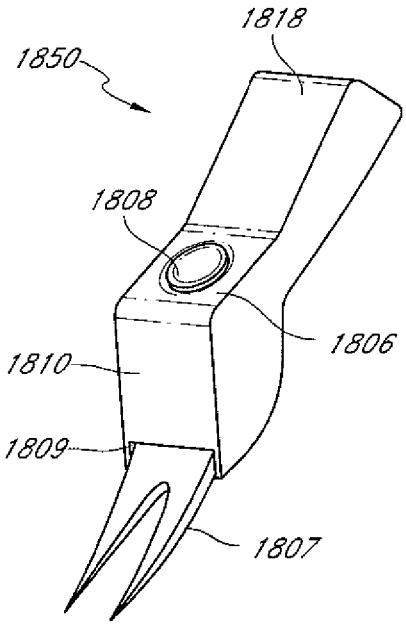
Figure 18C:
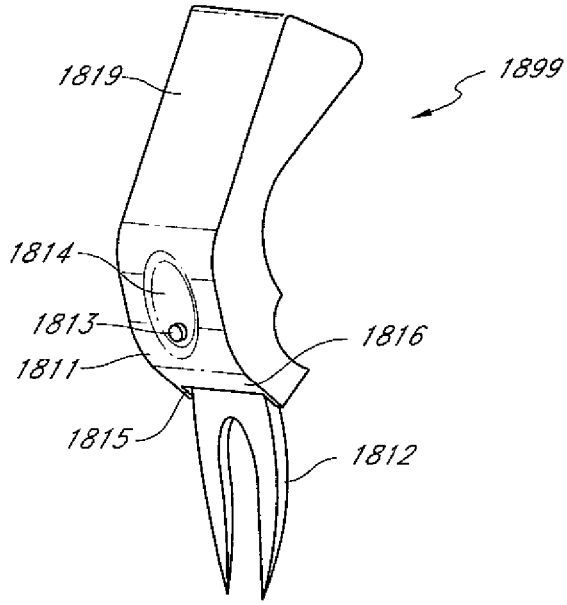

FIGS. 18A-18C show frontal views of divot repair tools according to different embodiments, shown in a deployed or open position. Tool 1800 in FIG. 18A has its blade member 1802 deployed from a horizontal opening 1801 via an activation button 1803 located on the front face 1805 of the tool 1800. Tool 1800 also has a thumb depression 1804 located on the housing 1817 to enhance a user's leverage in ball mark repair. FIGS. 18A-18C and other embodiments herein can be of any suitable size. For example, the devices can be at least 1.5 inches in length, at least 0.75 inch in width, at least 0.5 of an inch in height and/or have any type of blade member, e.g. curved, flat, tapered or any combination thereof. In the open position, the blade member 1802 can be fixed at a specified angle with respect to the housing/handle 1817 as described in connection with other tools herein so as to encourage the proper insertion and levering of the tool 1800 during use. FIGS. 18A-18C can be used in the methods of activating/deactivating a divot repair tool and used in methods of repairing a divot, which methods are more fully described elsewhere herein.

Tool 1850 of FIG. 18B features an up-slope 1806 at the front of the top of the housing 1818 where a user finds the activation button 1808 that can deploy and retract blade member 1807 from the horizontal opening 1809 located at the bottom of the front face 1810 of the tool 1850. There is no depression for the thumb in tool 1850 as the thumb can rest on the activation button 1808 to gain leverage. For example, the button 1808 can be comprised of rubber or some other sufficient material for enhanced gripping purposes. In the open position, the blade member 1807 can be fixed at a specified angle with respect to the handle 1818 as described in connection with other tools herein so as to encourage the proper insertion and levering of the tool 1850 during use.

The tool 1899 of FIG. 18C features a down-slope 1811 at the front of its housing 1819 where a user could place a thumb in the depression 1814 to press the activation button 1813 that can deploy and retract the blade member 1812 from behind the horizontal opening 1815 located at the bottom of the front face 1816 of tool 1899. In the open position, the blade member 1812 can be fixed at a specified angle with respect to the handle 1819 as described in connection with other tools herein so as to encourage the proper insertion and levering of the tool 1899 during use.

Figure 19A:
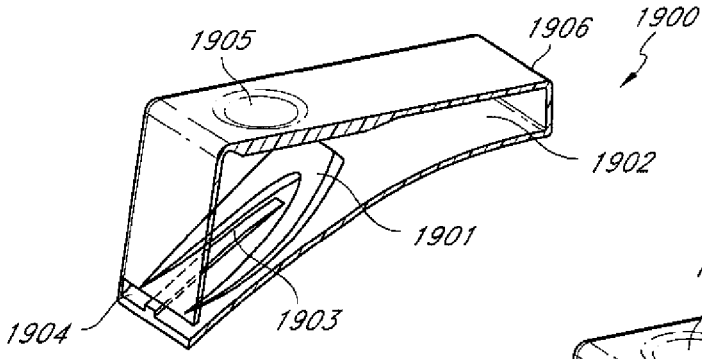
FIGS. 19A-19D show a side and bottom perspective of an embodiment that has a undercarriage mounted activation system to deploy and contract tines from a housing that acts as a handle in divot repair.
Figure 19B:
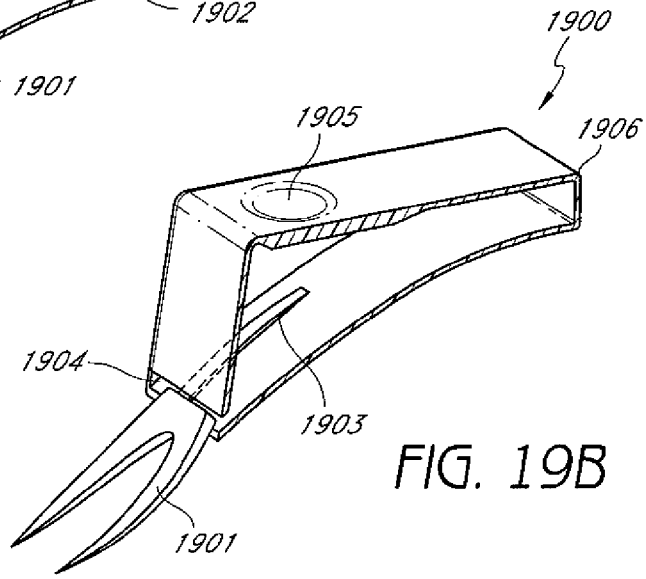

FIGS. 19A-19B show a side interior view of a divot repair tool 1900 according to another embodiment. FIG. 19A shows tool 1900 with the blade member 1901 retracted and resting with a horizontal bias in the cavity 1902 of the housing 1906 of tool 1900. The blade member 1901 is situated over a track, groove, insert or directional guide mechanism 1903 to which an activation mechanism (shown in FIGS. 19C-19D as button 1907) of said blade member can either be directly or indirectly connected and where the activation mechanism is located on the undercarriage of tool 1900. In a closed position, the blade member 1901 is also situated behind the horizontal opening 1904 from which the blade member 1901 exits the cavity 1902. As illustrated, tool 1900 has a thumb depression 1905 on the top side of the device to guide the hand in use and provide leverage. These and other embodiments can be of any suitable length, height and/or width. For example, these and other embodiments can be at least 1.5 inches in length, at least 0.75 inch in width and/or at least 0.5 of an inch in height. In the open position, the blade member 1901 can be fixed at a specified angle with respect to the handle/housing 1906 as described in connection with other tools herein so as to encourage the proper insertion and levering of the tool 1900 during use. The blade member 1901 of the tool 1900 is depicted with curved tines, but they could be straight/flat, tapered or any combination thereof in this or any other embodiment. FIGS. 19A-19B can be used in the methods of activating/deactivating a divot repair tool and used in methods of repairing a divot, which methods are more fully described elsewhere herein.

Figure 19C:
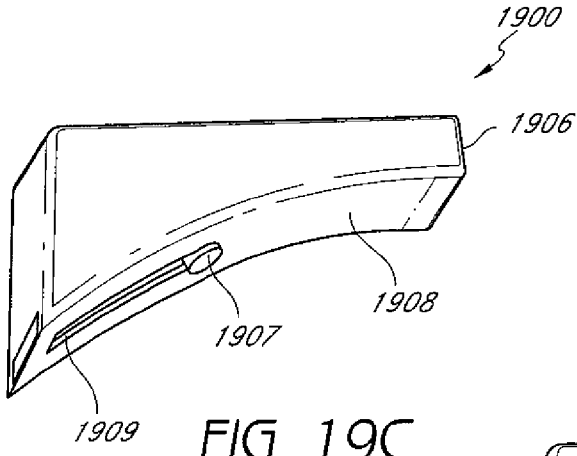
Figure 19D:
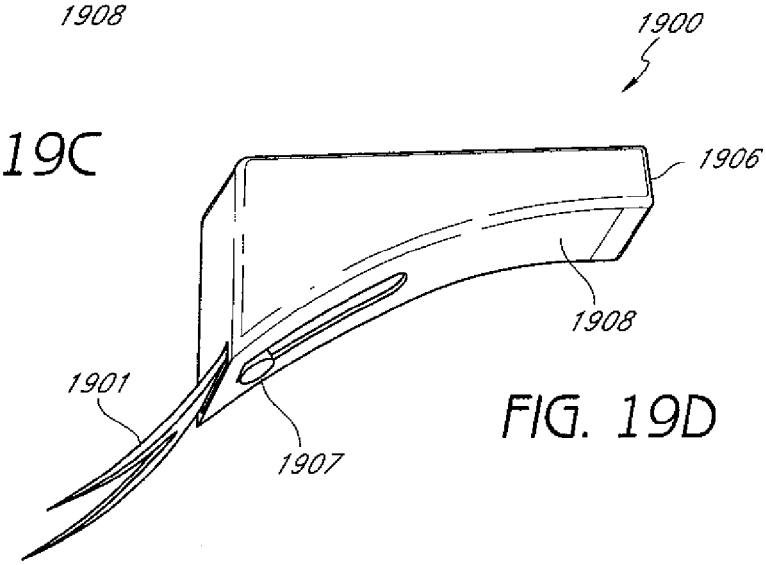

FIGS. 19C-19D depict an exterior view of the undercarriage 1908 of divot repair tool 1900. The illustration includes the activation mechanism 1907, that deploys the blade member 1901 from the housing 1906 and also retracts said blade member back into said housing. The activation mechanism 1907 can be made of hard plastic, rubber, metal or a combination thereof and operate by a similar means to the activation mechanism of a common carpet knife where, in the case of tool 1900, the blade member 1901 is engaged and released from the cavity 1902 by pressing down on the activation mechanism 1907 and then sliding it toward the front end of the activation mechanism channel 1909. The blade member 1901 locks into place when the user stops applying downward pressure to the button 1907. This type of activation mechanism 1907, where a user releases, slides and locks a blade member from a cavity inside a housing and then returns the blade member back into the cavity can apply to other embodiments of divot repair tools where an activation mechanism is placed on any of the external sides of any embodiment. FIG. 19C shows the blade member 1901 of tool 1900 retracted into the housing 1906 and FIG. 19D shows the blade member 1901 deployed. The blade member 1901 can be directly connected to the activation mechanism 1907, or the activation mechanism 1907 can be connected to an intermediary component, such as a spring, which can release the blade member 1901 from the housing 1906. There can also be a hinge which locks the blade member 1901 into a fixed position advantageous to the art of fixing ball marks when it fully exits the housing 1906. FIGS. 19C-19D can be used in the methods of activating/deactivating a divot repair tool and used in methods of repairing a divot, which methods are more fully described elsewhere herein.

Figure 20A:
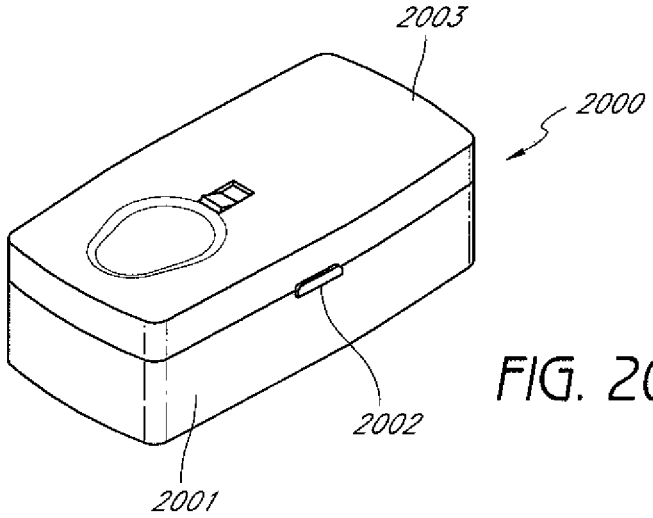
FIGS. 20A-20E show perspectives of two embodiments that have clamshell housings which can open and close in order to assist in cleaning and maintaining tools with cavities that store and deploy tines.
Figure 20B:
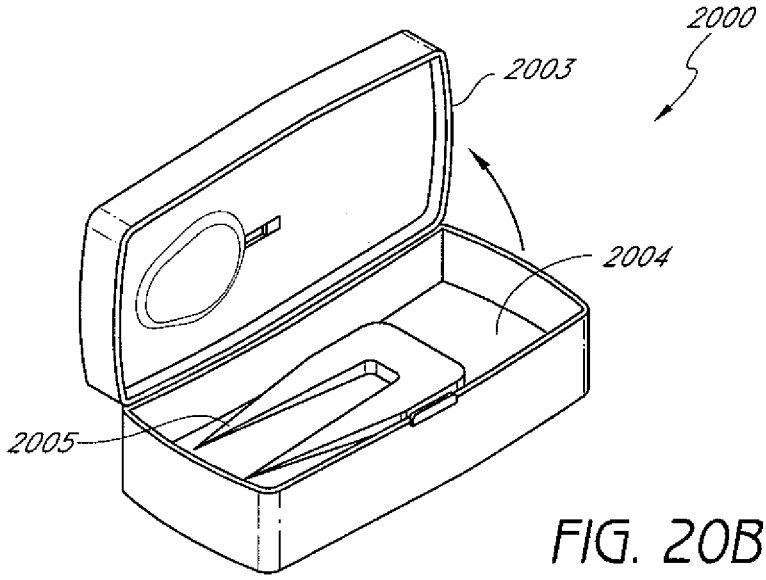

FIGS. 20A-20E illustrate two embodiments of a divot repair tool that have a clamshell opening that allows for cleaning, maintenance and even for repairs or replacing parts of some divot repair tools. FIGS. 20A-20B relate to divot repair tool 2000 where the tool's housing is comprised of two parts, a lower half 2001 and a top half 2003. In FIG. 20A, the top half 2003 is locked to its lower half 2001 by its connecting mechanism 2002. FIG. 20B illustrates that when the connecting mechanism 2002 is unlocked, the top section 2003 of the tool 2000 hinges back to open said tool, allowing the device to be turned over and shaken or cleaned by other means. Obviously, if divot repair related debris builds up in the tool's cavity during the course of use, it can negatively impact the working parts of the device in its cavity 2004, jam the blade member 2005 from deploying or retracting and even deposit annoying bits of divot sediment in a user's pocket. Cleaning a tool, therefore, could be a favorable option. Furthermore, if oil or another lubricant is required to maintain a tool, it can be applied when the top is open. The top half 2003 can connect to the lower half 2001 via clasps, or connecting points such as screws, inserts, form fitting pieces or other connective parts that allow two sides to be separated and then re-attached for use. When deployed, the blade member 2005 can be fixed at a specified angle with respect to the housing of the tool 2000 as described in connection with other tools herein so as to encourage the proper insertion and levering of the device during use. The tool 2000 can have a blade member featuring tines that are curved, flat, tapered or combination thereof. The tool 2000 can be assigned designs, logos, text, trademarks, colors and/or artistic themes and be used in the methods of repairing a divot, which methods are more fully described elsewhere herein.

Figure 20C:
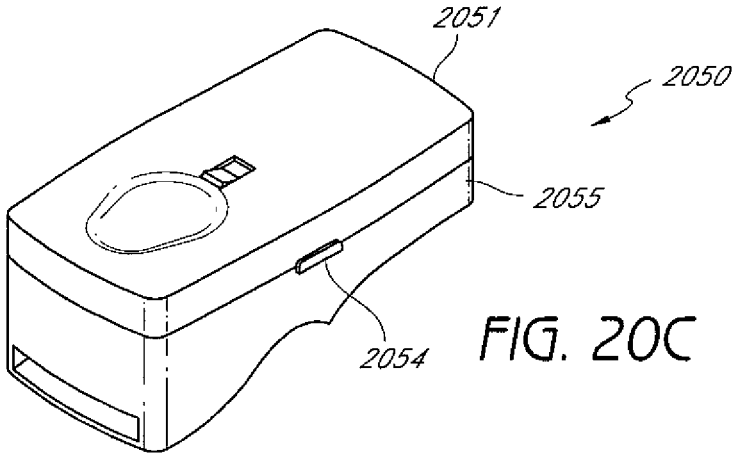
Figure 20D:
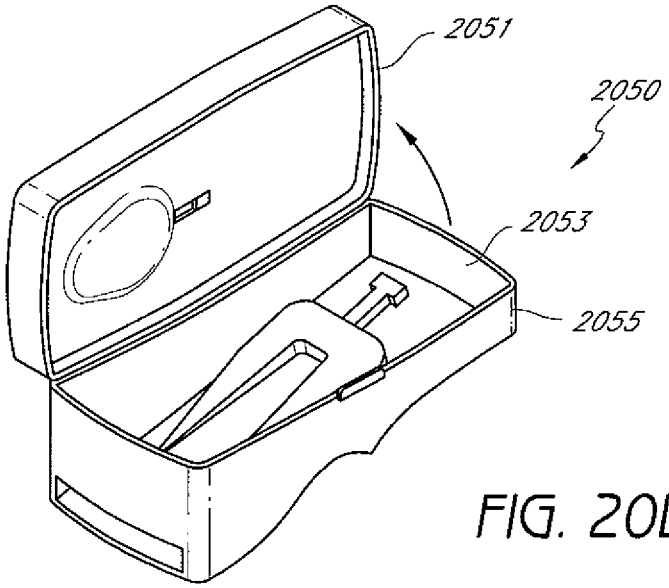
Figure 20E:
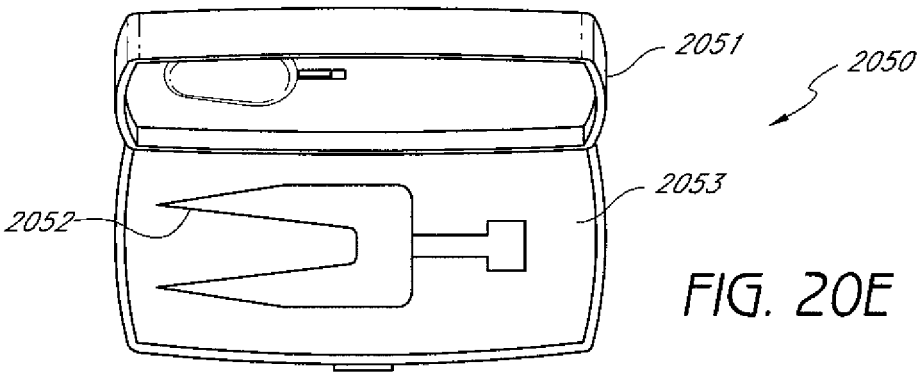
Figure 21A:
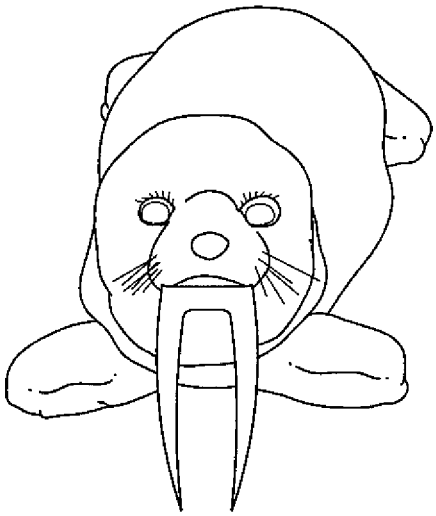
FIGS. 21A-B depict a device designed such that the tines appear to be the teeth of an animal.
Figure 21B:
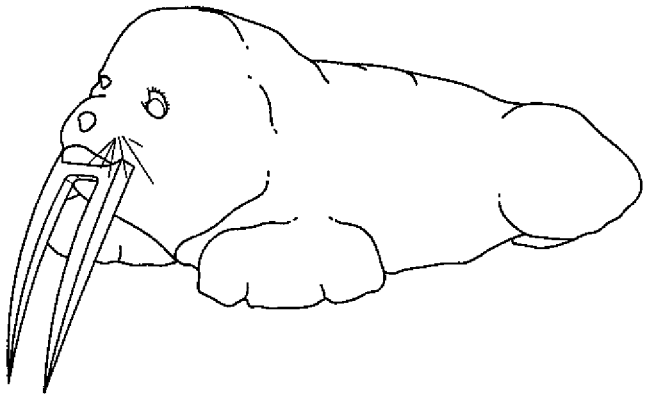

FIGS. 20C-20E illustrate divot repair tool 2050. FIG. 20C shows a side angled view of tool 2050 with its top 2051 half connected to its bottom half 2055 and the blade member in a retracted state inside the tool locked by the mechanism 2054. FIG. 20D shows a side angled view of tool 2050 with its top half 2051 open and its cavity 2053 slightly exposed. FIG. 20E is a straight downward view of the top side of tool 2050 with the top 2051 open, with the blade member 2052 fully exposed resting in the cavity 2053. From the open position, the device can be maintained, cleaned or serviced, including installing any replacement parts. FIGS. 20C-20E can be used in the methods of opening/closing and connecting the housing of a divot repair tool for maintenance purposes of its cavity and internal working parts more fully described elsewhere herein. When deployed, the blade member 2052 can be fixed at a specified angle with respect to the housing of the tool 2050 as described in connection with other tools herein so as to encourage the proper insertion and levering of the device during use. The tool 2050 can have a blade member featuring tines that are curved, flat, tapered or combination thereof. The tool 2050 can be assigned designs, logos, text, trademarks, colors and/or artistic themes and be used in the methods of repairing a divot, which methods are more fully described elsewhere herein.

In some embodiments the devices or repair tools can have a handle with contraction capabilities. In other words, the ability to extend the length of the handle can be activated by the user through a variety of means. It can be a spring loaded mechanism, a telescopic piece that slides and locks, or it can fold out from the main housing and lock into place via some type of hinge mechanism. Such handles can make the device smaller when not fully deployed so that it fits comfortably in a user's pocket, or stored in a bag, but that can expand in size to accentuate the embodiment's leverage, ergonomics and overall usability when used to repair a ball mark. The handle lengthening option can be integrated into the device's other movements to deploy the tines, or a separate exclusive action defined to the handle itself.

Finally, some embodiments of the device are versions where either the housing of the tines, or the handle apparatus itself, can incorporate the form of familiar shapes (Cable Car, Statue of Liberty), themes (U.S. Flag) or commercial licenses, such as Disney® characters (Dumbo, Goofy, Mickey, Minnie, etc.), NASCAR® vehicles such as those driven by Dale Earnhardt, Jr. Richard Petty, Mark Martin and other drivers and any other distinguishing mascot or logo. Other golf tool designs, for example, could be movie characters or figures (Star Wars), breeds of dogs (St. Bernards, Labradors, etc.) or even other animals. For example, there could be a tool shaped like an animal, where for example, the tines or blade represent part of the animal such as the teeth. FIG. 21 depicts once such device where the tines appear to be the teeth of an animal (e.g., a walrus, a seal, a rodent, a hippopotamus, etc.). For example, the divot tool can include tines curved like an iconic animals' tusks, such as the walrus for example, so that they bow out before turning inward, similar to those depicted in FIG. 5B. In some cases, the 'walrus' embodiment could apply specifically to aspects relating to the tines and in other embodiments, it could apply to other aspects or combinations of aspects of the tool, such as the handle and the tines. In short, any of the devices can be crafted to conform to a variety of licensed images, logos or designs (airplanes, cars, corporate images or famous buildings). Also, any of the embodiments can contain a display screen that is solar powered, battery powered or rechargeable and displays information on said screen whether it comes from an internal programmed source such as a microchip, or an external wireless or GPS source. Applications could even include technology that delivers yardages on the course, text messages from a cellular source or content retrieved from, or sent by, an Internet source via a wireless technology such as Bluetooth. Lastly, versions of any embodiment can be designed and manufactured to offer blended features such as a key chain apparatus, bottle opener, belt clip or cigar cutting blade. For example, the key chain apparatus can be drilled into and/or affixed to a tool so that the tool can also be a key chain. There can also be a bottle opening device integrated into one of the external facings of a tool so that it can open up a bottle. For example, the rear end of the undercarriage of a tool could feature a bottle opener allowing the user to apply the leverage of the handle to the task of bottle opening. Additionally, an external facing could have a clasp or clip that allows a golfer to attach the tool to a belt, golf cart visor and/or an appropriate external face of another item, such as a golf bag. Lastly, some tools can have a cavity to store and retract a small cigar tool such as cutting knife.

As mentioned elsewhere herein, current divot repair tools are not intuitive, comfortable, or easily manipulated when being used to repair divots. Therefore, users, although well intentioned, often do more harm than good to golf greens and can also do harm to their hands and joints. Some of the instant embodiments relate to methods for repairing a divot in a golf course green, including by using any of the devices described herein. In some aspects the methods can include the steps of grasping the device and placing either thumb in the depression with wrapping the remaining fingers of the hand around the handle. Preferably the handle can have a shape that facilitates the handling of the device in the palm, hand and fingers. Once in the user's grasp, the device easily takes the weight of the individual and effectively transfers force as it is inserted into the ground at the edges of the ball mark. Once in the affected turf, the device can be properly levered by pulling up on the handle or lifting the handle in a substantially vertical direction. In some aspects, the handle, it should be noted, cannot be pushed down—which would pull up the ball mark and damage the roots—because the handle is parallel and close to the ground when it is inserted into the turf. Once the device is pulled up and the earth pushed horizontally towards the center of the ball mark, the grass is un-bunched or decompacted and its vertical roots are not destroyed in the process—which allows quick and proper healing. Depending on the depth and other size characteristics of the ball mark, the same action can be repeated until the ball mark has been adequately repaired. As noted, there may be text instructions, or visual images, on parts of the device to remind the user of proper device application. For example, the instructions can include at least a portion of the following: a. Place thumb in depression and wrap hand around tool b. Insert forks at edges of ball mark c. Move tool towards center of ball mark by lifting rear of handle; and d. Repeat as necessary. The text can also include any other message, commercial, inspirational, visual or a combination thereof. Furthermore, the instructions and/or display information can include a combination of images and/or text.

In some embodiments, the devices can take advantage of the powerful force of leverage. The handle and overall design attributes of many of the devices described herein accentuate the accessibility of leverage, a factor by which a lever multiplies a force. In this case, one by the hand and arm as a golfer repairs tightly compacted grass. Many of the devices described herein can be utilized in the methods for repair since the devices permit proper green repair. For example, the devices of FIGS. 1A-1D, 2A-2C, 3A-3C, 4A-4B, 5A-5B, 6A-6F, 7B, 8A-8C, 9A-9C 10A-10E, 11A-11E, 12A-12D, 13A-13D, 14A-14C, 15A-15C, 16A-16C, 17A-17L, 18A-18C, 19A-19D, 20A-20E and 21A-B can be used in the methods described above to properly repair a ball mark that a golfer would find in a green.

The devices can be made by any suitable method. In view of the disclosure herein, one of skill in the art will easily recognize the various components that can be used depending upon the particular design and configuration that is desired. For example, the tines can be made of any suitable material, in particular materials with sufficient strength and/or durability to permit movement of the soil and grass of a golf green. Preferably the tines can be made of a metal or sufficiently hard plastic or polymer. The tines, as mentioned elsewhere, can be part of a single piece or can be individual tines that connect to the body or other component. The housing or body of the devices can be made of any suitable material, including wood, metals, plastics, other polymers, alloys, synthetics, carbons, ceramics, clays, and the like. The various components can be joined together by any suitable mechanism, including for example, using rivets, screws, plates, rods, pins, clasps, clamps, fitted joints, specialty components, adhesives, gearing, welding, clays, hinges, epoxies, glues, and the like.

It will be appreciated by those skilled in the art that various modifications and changes may be made without departing from the scope of the described technology. Such modifications and changes are intended to fall within the scope of the embodiments, as defined by the appended claims. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A divot repair tool comprising:

a blade member comprising at least two tines; and a handle comprising a housing and an activation mechanism disposed within or on a top surface of the handle, which activation mechanism of the handle is operatively coupled to the blade member to deploy the tines of the blade member from the housing and to retract said tines of the blade member into the housing, wherein the blade member is at least partially moveable with respect to the handle between at least a first position and a second position, wherein in the first position, the tines of the blade member are at least partially stored within the housing of the handle, and in the second position, at least the tines of the blade member are deployed outside of the housing, wherein in the second position, a bottom surface of the handle and the deployed tines form an angle under the divot repair tool of between 110° and 160°, and wherein the divot repair tool is sized and oriented such that downward movement of a rear end of the handle is restricted when the handle is gripped with the deployed tines in the ground and the top surface of the handle facing upward.

2. The divot repair tool of claim 1, wherein the angle under the divot repair tool is between 120° and 150°.

3. The divot repair tool of claim 1, wherein the blade member is slidably retractable into the first position.

4. The divot repair tool of claim 1, wherein the blade member is at least slidably movable into the second position.

5. The divot repair tool of claim 1, wherein the handle has a length of at least 1.5 inches, a width of at least 0.75 inch and/or a height of at least 0.5 inch.

6. The divot repair tool of claim 1, wherein the handle comprises a display portion for displaying information demonstrating proper use.

7. The divot repair tool of claim 1, wherein the external parts of the tool comprise a display portion for displaying promotional content, artwork, designs and other information.

8. A method of repairing a divot, comprising:

providing a divot repair tool, the tool comprising a blade member and a handle operatively coupled to the blade member;

gripping the divot repair tool with a top surface of the handle facing upward, wherein the handle and the blade member are configured such that downward movement of a rear end of the handle is restricted when the handle is gripped with the deployed tines in the ground and the top surface of the handle facing upward;

inserting the blade member into the ground at a first location near an edge of the divot with the handle generally parallel to the ground and the blade member directed towards the ground such that the blade member and a bottom surface of the handle form an angle under the divot repair tool of between 110° and 160°:

moving the rear end of the handle generally upward so as to push the ground horizontally near the edge of the divot toward the center of the divot; and repeating said inserting and said moving, at one or more additional locations around the edge of the divot until the divot is adequately repaired.

9. The method of claim 8, further comprising deploying the blade member from within a cavity in the handle in order to dispose the handle at the angle of between 110' and 160° from the blade member.

10. The method of claim 8, further comprising retracting the blade member to within a cavity in the handle after repairing said divot.

11. The divot repair tool of claim 1, wherein the activation mechanism comprises, in part, an activation button.

12. The divot repair tool of claim 1, further comprising at least one opening on the bottom surface of the housing through which at least a portion of the blade member advances upon deployment of the blade member from the first position to the second position.

13. The divot repair tool of claim 1, wherein the housing comprises a top portion and a bottom portion separably coupled together.

* * * * *